US006711531B1

(12) United States Patent
Tanaka et al.

(10) Patent No.: US 6,711,531 B1
(45) Date of Patent: Mar. 23, 2004

(54) TEMPERATURE CONTROL SIMULATION METHOD AND APPARATUS

(75) Inventors: Kazuo Tanaka, Tokyo (JP); Hideto Yamaguchi, Tokyo (JP); Kenzo Urabe, Tokyo (JP)

(73) Assignee: Kokusai Electric Co., Ltd., Tokyo (JP)

( * ) Notice: Subject to any disclaimer, the term of this patent is extended or adjusted under 35 U.S.C. 154(b) by 0 days.

(21) Appl. No.: 09/369,926

(22) Filed: Aug. 9, 1999

(30) Foreign Application Priority Data

Aug. 13, 1998 (JP) ..... 10-228770

(51) Int. Cl.[7] ..... G06G 7/48

(52) U.S. Cl. ..... 703/6; 700/31; 703/2; 703/7

(58) Field of Search ..... 700/31; 703/2, 703/6, 7

(56) References Cited

U.S. PATENT DOCUMENTS

| | | | | | |
|---|---|---|---|---|---|
| 3,681,681 | A | * | 8/1972 | Auslander | 324/417 |
| 4,657,507 | A | * | 4/1987 | Kohama et al. | 432/18 |
| 4,753,192 | A | * | 6/1988 | Goldsmith et al. | 118/715 |
| 4,802,441 | A | * | 2/1989 | Waugh | 118/666 |
| 5,365,864 | A | * | 11/1994 | Switzer | 110/235 |
| 5,406,581 | A | * | 4/1995 | Staib et al. | 373/102 |
| 5,537,310 | A | * | 7/1996 | Tanake et al. | 700/31 |
| 5,561,612 | A | * | 10/1996 | Thakur | 374/121 |
| 5,654,904 | A | * | 8/1997 | Thakur | 204/298.03 |

FOREIGN PATENT DOCUMENTS

| | | | | |
|---|---|---|---|---|
| GB | 2 171 185 A | * | 8/1996 | F27B/9/30 |
| JP | 03252390 A | * | 11/1991 | C30B/15/22 |
| US | 0 646 658 A1 | * | 8/1994 | C23C/2/06 |

OTHER PUBLICATIONS

"Modeling Furnace Operations using Simulation and Heuristics, B. Ram, Proceedings Winter Simulation Conference, 1998".*

"Simulation of a Heat Treatment Furnace Intoduces Industrial Reality in an EET Undergraduate Control Course", A. Oxtoby, 1991 Frountires in Education Conference, pp. 491–494, IEEE 1991.*

"A New Time Domain Voltage Source Model for an ARC Furnace using EMTP", S. Varadan, IEEE Transaction on Power Delivery, vol II, No. 3, Jul. 1996.*

"Evolution of Simulation Techniques to Model Electric Glass Furnances", R. Murnane, Industry Applications Society Annual Meeting, pp. 1384–13994, IEEE1989.*

"Accurate Modeling of Interelectrode Resistance and Power Dissipation in Electric Glass Melters", A. Ghandakly, IEEE Transaction on Industry Applications, vol. 24, No. 6, pp. 1057–1061, IEEE 1988.*

"A Mini–Fab Simulation Model comparing FIFO and MIVP schedule policies (outer loop), and PID and H machine controllers (inner loop) for semiconductor diffusion bay maintenance", J. Flores–Godoy, Industrial Elelctronics Society Proceedings, IEEE Jul. 1998.*

"Modeling Furnace Operations using Simulation and Heuristics, B. Ram, Proceedings Winter Simulation Conference, 1998".*

* cited by examiner

*Primary Examiner*—Hugh Jones
*Assistant Examiner*—Fred Ferris
(74) *Attorney, Agent, or Firm*—McGinn & Gibb, PLLC

(57) ABSTRACT

A temperature control simulation method and apparatus for forming a temperature system simulation model on a computer, provide substantially the same response or simulation characteristics as a temperature change in an actual furnace, whereby a temperature control algorithm can be developed and the method or manner of manipulating the temperature control can be learned without using an actual furnace. A transfer function is determined which represents a relationship between a heater input and a temperature output. A temperature control simulation for a heating furnace is executed using the transfer function of a heating furnace as a transfer function that a temperature system simulation device uses.

6 Claims, 20 Drawing Sheets

$$\begin{bmatrix} I \\ J \\ K \\ L \end{bmatrix} = \begin{bmatrix} G_{11}(s) & G_{12}(s) & G_{13}(s) & G_{14}(s) \\ G_{21}(s) & G_{22}(s) & G_{23}(s) & G_{24}(s) \\ G_{31}(s) & G_{32}(s) & G_{33}(s) & G_{34}(s) \\ G_{41}(s) & G_{42}(s) & G_{43}(s) & G_{44}(s) \end{bmatrix} \begin{bmatrix} A \\ B \\ C \\ D \end{bmatrix}$$

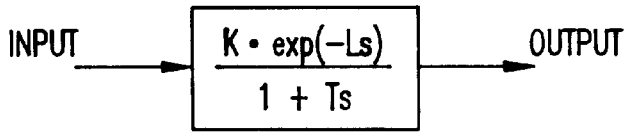
FIG.4
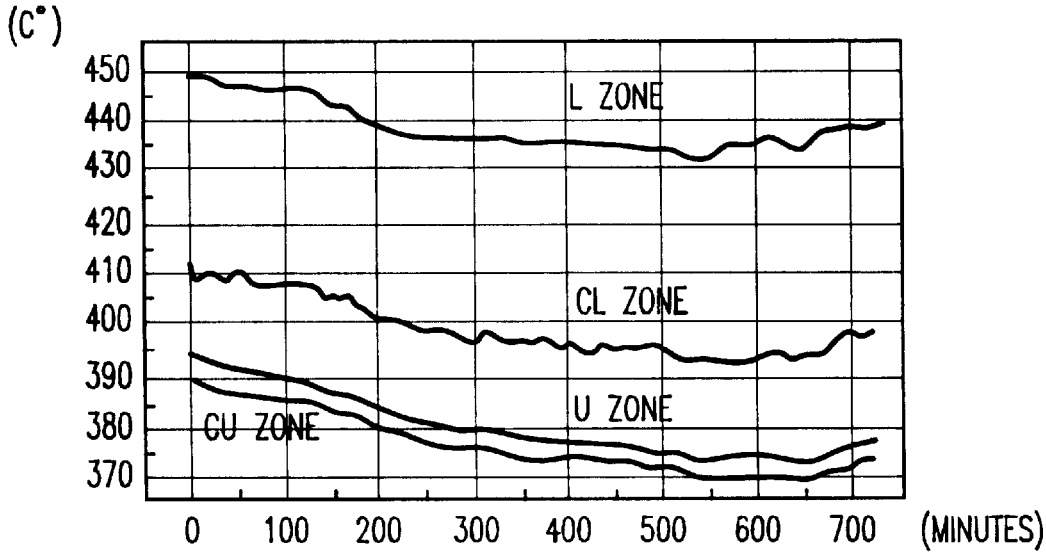
FIG.5 TEMPERATURE CHANGE WITH CONSTANT QUANTITY OF MANIPULATION (12 HOURS)
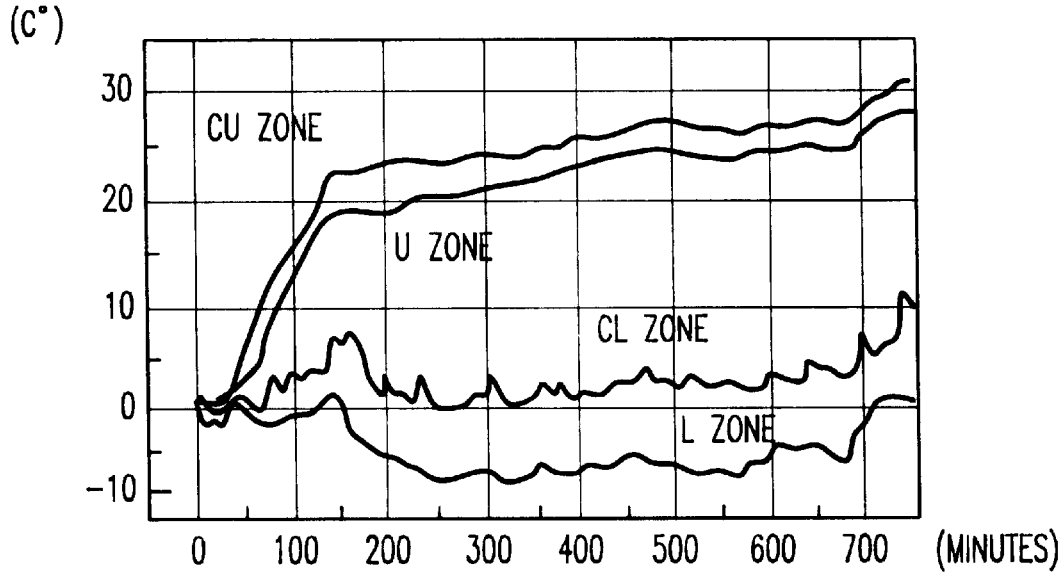
FIG.6 STEPPED RESPONSE DATA BEFORE CORRECTION (WITH INITIAL TEMPERATURE 0 °C)

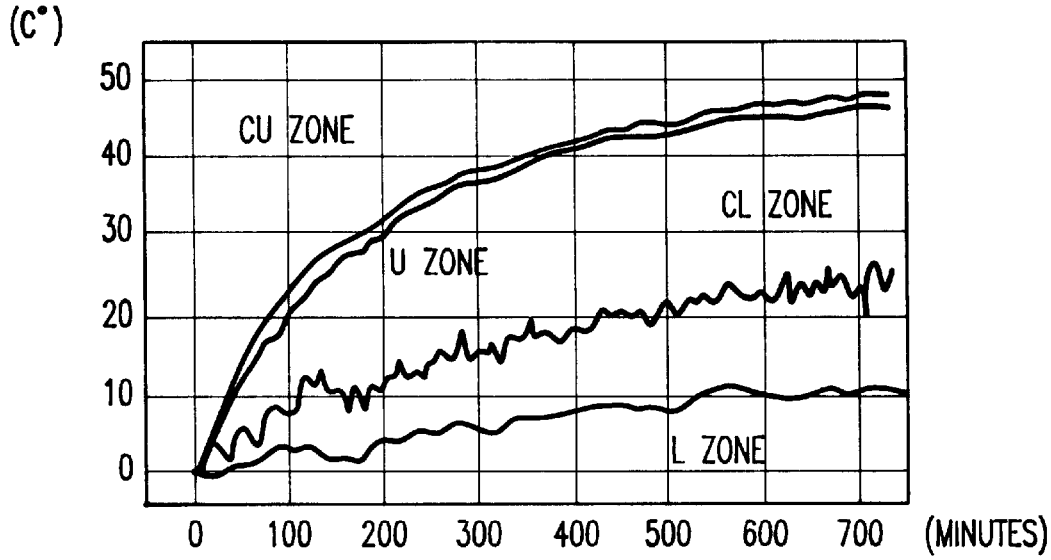
FIG.7 STEPPED RESPONSE DATA AFTER CORRECTION (WITH INITIAL TEMPERATURE 0°C)
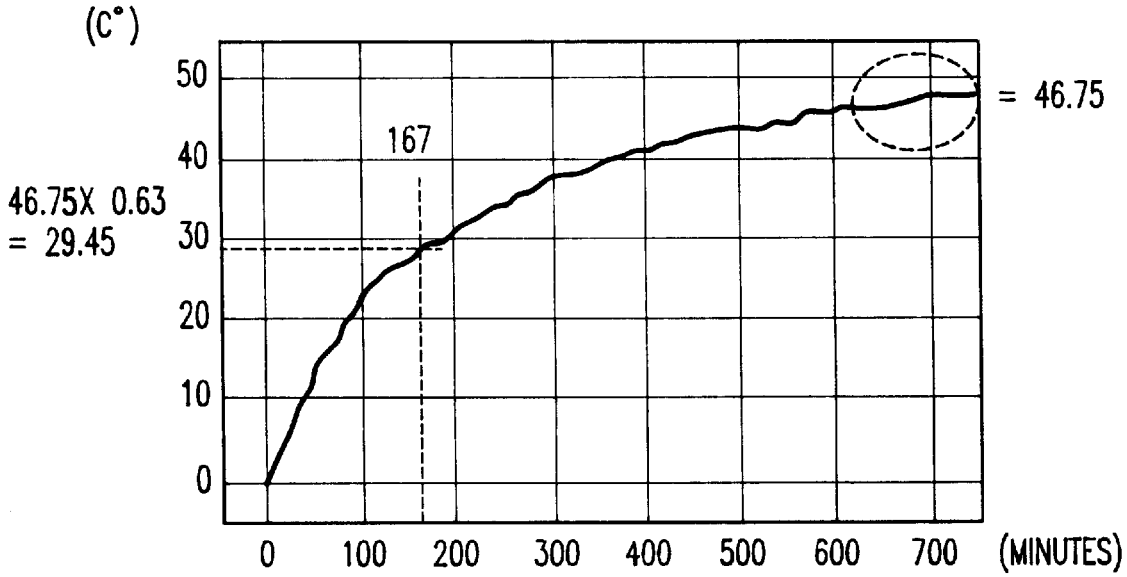
FIG.8 STEPPED RESPONSE DATA AFTER CORRECTION (CU ZONE ALONE, WITH INITIAL TEMPERATURE 0°C)

EXAMPLE OF FURNACE TEMPERATURE CHANGE DURING BOARD LOADING

PATTERN EXAMPLE OF TIME CONSTANT CHANGE OVER TIME

[K,T,L] U_u=[22.6, 55, 0.4] , [K,T,L] CU_u[8.55,131, 2.0]
[K,T,L] CL_u=[2, 300, 2.0] , [K,T,L] L_u[1, 400, 2.0]

[K,T,L] U_u=[0.7163(=16.19/22.6), 1, 0.2], [K,T,L] CU_u[0.89, 1, 0.5]
[K,T,L] CL_u=[1, 1, 0.5], [K,T,L] L_u[1, 1, 0.5]

[K,T,L] U_u=[46.38, 184*3, 1.0], [K,T,L] CU_u=[46.75, 167, 0.4]
[K,T,L] CL_u=[22.97, 256, 1.0], [K,T,L] L_u=[9.38, 328, 2.0]

[K,T,L] U_u=[1.045, 1, 0.5], [K,T,L] CU_u=[0.94, 1.8, 2.0]
[K,T,L] CL_u=[1.30, 3, 0.5], [K,T,L] L_u=[1, 22.3, 0.5]

[K,T,L] U_cl=[10.72, 239, 2.0], [K,T,L] CU_cl=[12.94, 200, 2.0]
[K,T,L] CL_cl=[24.79, 73, 0.4], [K,T,L] L_cl= [11.86, 103*1.5, 2.0]

[K,T,L] U_cl=[1, 1, 0.5], [K,T,L] CU_cl=[1, 1, 0.5]
[K,T,L] CL_cl=[0.7145, 1.5, 0.2], [K,T,L] L_cl=[1, 1, 0.5]

[K,T,L] U_I=[0.5, 520, 2.0], [K,T,L] CU_I=[1, 410, 2.0]
[K,T,L] CL_I=[3.05, 118, 1.0], [K,T,L] L_I=[8.475, 15*3, 0.4]

[K,T,L] U_I=[1, 1, 0.5], [K,T,L] CU_I=[1, 1, 0.5]
[K,T,L] CL_I=[0.531, 2, 0.5], [K,T,L] L_I=[0.7062, 1, 0.2]

PRIOR ART FIG.22
HEATER CONTROL MODE
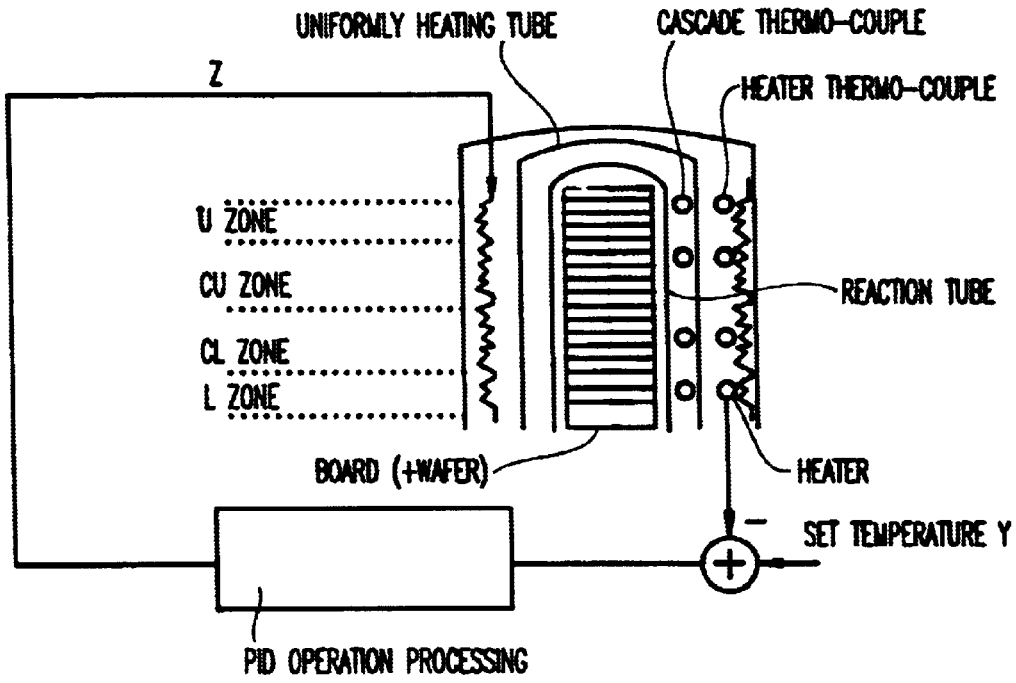
PRIOR ART FIG.23
CASCADE CONTROL MODE
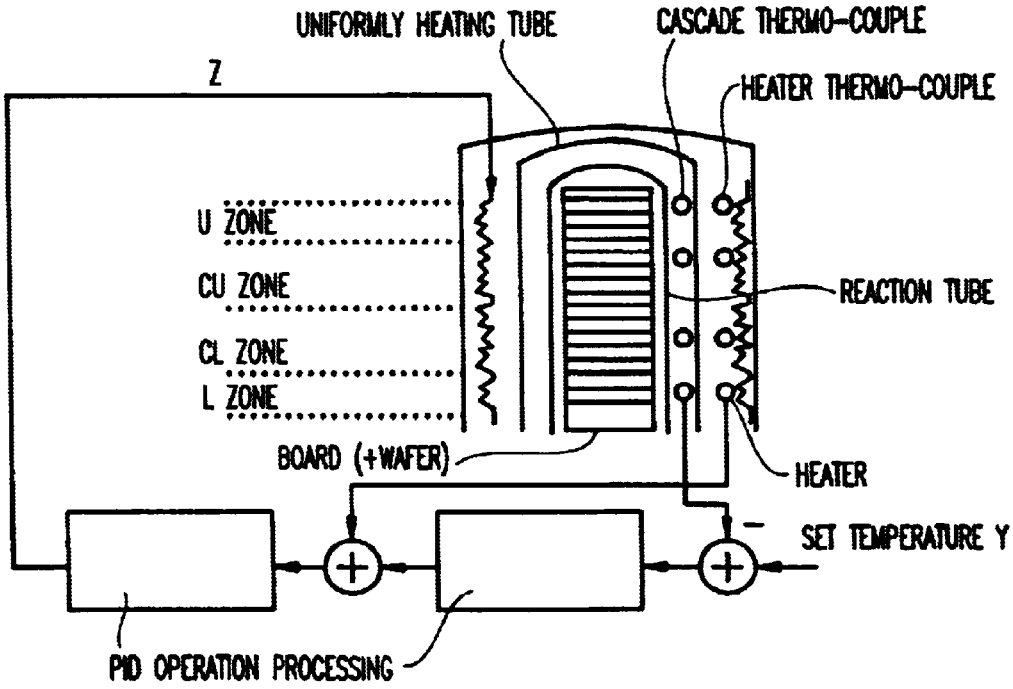

TEMPERATURE CHANGE UPON BOARD LOADING IN HEATER CONTROL MODE (CU ZONE ALONE)

TEMPERATURE CHANGE UPON BOARD LOADING IN HEATER CONTROL MODE (CU ZONE ALONE, HEATER THERMO-COUPLE TEMPERATURE ALONE)

TEMPERATURE CHANGE UPON BOARD IN CASCADE CONTROL MODE
(CU ZONE ALONE)

TEMPERATURE CHANGE UPON BOARD LOADING IN HEATER CONTROL MODE
(CU ZONE ALONE, HEATER THERMO-COUPLE TEMPERATURE ALONE)

TEMPERATURE CHANGE UPON BOARD LOADING IN HEATER CONTROL MODE (HEATER THERMO-COUPLE ALONE)

TEMPERATURE CHANGE UPON BOARD LOADING IN CASCADE CONTROL MODE (CASCADE THERMO-COUPLE ALONE)

BOARD LOADING AT 500°C, CASCADE TEMPERATURE

BOARD LOADING AT 500°C, CASCADE TEMPERATURE (ON ENLARGED SCALE)

TEMPERATURE CONTROL SIMULATION METHOD AND APPARATUS

BACKGROUND OF THE INVENTION

1. Field of the Invention

The present invention relates to an apparatus such as an electric furnace, a gas furnace, a steam furnace, etc., and more particularly to a temperature control simulation method and apparatus for developing a temperature control algorithm and learning a temperature control manipulation process in such a process apparatus without using an actual furnace.

2. Description of the Related Art

A temperature control simulation in a semiconductor manufacturing apparatus using an electric furnace is known.

FIG. 32 is a block diagram which shows an electric furnace of a vertical diffusion apparatus used as a semiconductor manufacturing apparatus. The electric furnace system, as illustrated in FIG. 32, includes a heater 1101 for heating a furnace, a heater thermo-couple 1102 for detecting the temperature of the heater 1101, a cascade thermo-couple 1105 for detecting the temperatures of intermediate portions between a uniform heating tube 1103 and a reaction tube 1104, a boat 1106 mounted thereon with a wafer to be heat-treated, and a temperature controller 1107 for calculating a quantity of manipulation (i.e., a value of electric power) Z applied to the heater 1101 based on the detected temperatures of the heater thermo-couple 1102 and the cascade thermo-couple 1105 and a preset temperature Y.

Heater 1101 is divided into a plurality of zones to control the furnace temperature with higher accuracy, and for instance, in the case of a four-zone division, the divided zones are sequentially called a U, CU, CL and L zone, etc., in order from top to bottom.

The heater thermo-couple 1102 and the cascade thermo-couple 1105 are disposed in each divided zone, and the quantity of manipulation Z given to the heater 1101 is calculated by an algorithm (e.g., PID arithmetic operations, etc.) in the temperature controller 1107 to adjust the value of electric power supplied to the heater 1101 while detecting the temperature of the heater thermo-couple 1102. This adjusts the detected temperature of the cascade thermo-couple 1105 to the set temperature Y.

Also, the boat 1106 having a wafer to be heat-treated, is inserted into the furnace, and is withdrawn after the wafer has been heat-treated. Subsequently, a new wafer to be heat treated is mounted on the boat 1106, which is again inserted into the furnace for heat treatment.

In the case of the vertical diffusion apparatus having an electric furnace as shown in FIG. 32, a process shown in FIGS. 33(*a*) and 33(*b*) is performed.

FIG. 33(*a*) shows a flow chart for one example of a treatment process performed by the vertical diffusion apparatus, and FIG. 33(*b*) schematically shows a temperature change in the furnace during the process treatment.

Step S1 is a process in which the furnace temperature is settled or stabilized at a comparatively low temperature $T_0$. In step S1, the boat 1106 has not yet been inserted into the furnace.

Step S2 is a process (boat loading) in which the boat 1106 is inserted or loaded into the furnace.

As the temperature of the wafer is usually lower than the target temperature $T_0$, the temperature in the furnace temporarily falls below the target temperature $T_0$ as a result of the boat loading.

A quantity of manipulation to the heater is adjusted by the temperature controller 1107 to allow the furnace temperature to quickly recover from this temperature fall, and to stabilize it at the target temperature $T_0$ within a slight temperature-variation range.

Step S3 is a process (e.g., ramp up) in which the temperature in the furnace is gradually raised or ramped up from the first target temperature $T_0$ to a second target temperature $T_1$ where the wafer is subjected to a process treatment such as layer-forming or deposition processing, etc.

When ramped up, the temperature in the furnace will rise in a delayed manner with respect to a target temperature, so a time period is required until the furnace temperature has been stabilized at the target temperature $T_1$ within a slight temperature range.

Step S4 is a process in which the temperature in the furnace is stabilized at the target temperature $T_1$ so as to subject the wafer to a treatment process.

Step S5 is a process in which the temperature in the furnace is gradually lowered from the second target temperature $T_1$ to the comparatively low first target temperature $T_0$.

Step S6 is a process in which the boat with the mounted wafer which has been subjected to the treatment process and is pulled out of the furnace.

Since steps S1 to S6 are repeated, performing each step in a shortened time leads to an improvement in productivity. In particular, regarding temperature control performance, it is necessary to shorten the time (settling time) required to settle or stabilize the furnace temperature at the target temperature, within a slight temperature range after loading of the boat with the wafer and ramping up the furnace temperature.

Therefore, for shortening the settling time during the boat loading and the furnace temperature ramp-up operation, as well as for conducting maintenance, design engineers for the semiconductor manufacturing apparatus and workers at the semiconductor manufacturing sites frequently must operate or manipulate the temperature controller while monitoring the temperature in the furnace.

The development of the temperature control algorithm and learning the temperature control operation have been accomplished by performing the process treatment as shown in FIG. 33(*a*) so as to control the temperature while using the apparatus shown in FIG. 32.

However, the apparatus of FIG. 32 is very expensive, requires a large installation space, and is dangerous because of the very high target temperatures at $T_0$ and $T_1$ ranging from about 300 degrees C. to about 500 degrees C. for $T_0$ and from about 800 degrees C. to 1200 degrees C. for $T_1$. In addition, some apparatuses use poisonous gases, so it is essential to carefully manage temperature control. Moreover, it requires more than about 3 to 6 hours to perform steps S1 through S6. Therefore, a method of reducing the costs and shortening the operating time is required.

SUMMARY OF THE INVENTION

In view of the foregoing and other problems, disadvantages, and drawbacks of the conventional process apparatus, the present invention has been devised, and it is an object of the invention to provide a temperature control simulation method and apparatus which can form, on a computer, a temperature simulation model for a process apparatus, such as an electric furnace, a gas furnace, a steam furnace, etc., which shows substantially the same temperature change as in an actual furnace. Thus, one may develop a temperature control algorithm and/or learn a temperature control manipulation method without using the actual furnace.

To achieve the above object, according to one aspect of the present invention, there is provided a temperature control simulation method in which transfer function means, representative of a relationship between an input to a heater and a temperature output thereof, is determined so that temperature control on a heating furnace can be performed by using the thus determined transfer function mechanism as that of a temperature system simulation device.

In a preferred form of the temperature control simulation method of the invention, the transfer function means comprises a heater system transfer function and a furnace system transfer function. By approximating each of these transfer functions as K·exp(−Ls)/(1+Ts), a total transfer function for the entire system is given by the following formula:

$$K_1 \cdot \exp(-L_1 s)/(1+T_1 s) \times K_2 \cdot \exp(-L_2 s)/(1+T_2 s) \quad (1)$$

where K is a gain, T is a time constant, L is a delay, suffix 1 indicates the heater system, and suffix 2 indicates a parameter of the furnace system.

Thus, the temperature control simulation for the heating furnace is obtained by using the total transfer function for the entire system.

In another preferred form of the temperature control simulation method of the invention, the transfer function has a parameter which changes over time in accordance with a temperature control process.

In a further preferred form of the temperature control simulation method of the invention, the time constants $T_1$ and $T_2$ of formula (1) change over time.

In a still further preferred form of the temperature control simulation method of the invention, the temperature control process includes controlling a temperature of the heating furnace during a time when a boat is loaded into the heating furnace, and the parameter of the transfer function means, which changes over time, comprises a time constant.

In a yet further preferred form of the temperature control simulation method of the invention, the time constant of the transfer function means is made to change over time during the boat loading, to represent an increase in the heat capacity with a model.

In another preferred form of the temperature control simulation method of the invention, the change over time is given by a second order delay curve.

In a further preferred form of the temperature control simulation method of the invention, the change over time of each of the time constants upon boat loading is expressed by using the following second order delay curve function and time constants Ta and Tb before and after the boat loading.

$$1+(\alpha \cdot \exp(-t/\alpha)-\beta \cdot \exp(-t/\beta))/(\beta-\alpha) \quad (2)$$

where β and α are constants experimentally determined, and t is a period of time.

In a further preferred form of the temperature control simulation method of the invention, the heating furnace includes a plurality of heating zones, and the heater comprises a plurality of heaters, one for each of the plurality of heating zones, and the transfer function means includes interference between the heating zones. If the heaters are provided in the plurality of heating zones, a heater in one heating zone influences the other zones.

For this reason, the transfer function means includes interference between the heating zones, thus making it possible to execute simulation by the transfer function means with high accuracy.

In a further preferred form of the temperature control simulation method of the invention, the transfer function means is determined by measuring an output of the furnace when a stepped input is applied to one of the plurality of heaters, repeating the process of measuring an output of the furnace for all the remaining heaters, and calculating the transfer function means based on the outputs of the furnace.

In a further preferred form of the temperature control simulation method of the invention, the transfer function means is determined from a stepped response of each of the heaters by calculating a temperature output response value of each of the heaters when a stepped input is applied to an associated heater, calculating a temperature output of each of the heaters when a constant input is applied to an associated heater at the same point of time as when the stepped input is applied to calculate a change over time of the temperature output of each of the heaters, and calculating the transfer function means based on the temperature output response value which is subtracted by the change over time of the temperature output of each of the heaters to cancel variations in a power supply which supplies electric power to the heaters.

With this arrangement, when parameters of the transfer function means are determined from the stepped input and the output, errors due to variations in the power supply voltage can be canceled.

In a further preferred form of the temperature control simulation method of the invention, the transfer function means comprises a plurality of transfer functions corresponding to a plurality of different temperature zones, and the plurality of transfer functions are switched among themselves to select the appropriate one corresponding to each one of the plurality of temperature zones.

When each transfer function is approximated by the above formula (1), the parameters of the transfer functions can change according to the respective temperature zones of the system.

Therefore, to effect such an approximation as accurately as possible, it is preferable that the entire temperature range used for the temperature control be divided into a plurality of temperature zones, and the parameters of the transfer functions be determined according to the respective temperature zones.

According to another aspect of the present invention, there is provided a temperature control simulation apparatus with a temperature system simulation device adapted for use in a temperature control simulation as discussed above; and a temperature controller for determining an input to the temperature system simulation device based on an output thereof With this arrangement, it is possible to simulate the temperature control in the same manner as an actual heating furnace is controlled, thus enhancing the training experience.

In a preferred form of the temperature control simulation apparatus of the invention, the apparatus has a converter for converting temperature information which is generated by the temperature system simulation device into a corresponding voltage signal.

In a further aspect of the present invention, there is provided a semiconductor manufacturing apparatus having the above temperature control simulation apparatus.

According to a further aspect of the present invention, there is provided a method of acquiring a transfer function, including defining an object to be controlled in a temperature system, which includes a heater for heating a furnace, by a series-type transfer function which includes a heater system transfer function and a furnace system transfer function, determining the heater system transfer function based on a relationship between an input to the heater and an output of a heater thermo-couple, and determining the furnace system transfer function based on a relationship between an input to the heater and an output of a cascade thermo-couple and based on the heater system transfer function determined above.

In a preferred form of the transfer function acquisition method of the invention, using the above-mentioned formula (1), the heater system transfer function is first determined based on an output of a heater thermo-couple, which is constructed, for example, as shown in FIG. 1, in response to a stepped input, and the furnace system transfer function is then determined based on an output of the cascade thermo-couple, and the heater system transfer function already determined.

In a preferred embodiment of the temperature control simulation apparatus of the invention, as illustrated in FIG. 1, the heating furnace includes M (e.g., 4) heating zones with a plurality of heaters, and a temperature rising pattern is formed in each heating zone when the power supply to an arbitrary one of the heaters is increased in a stepwise manner. The respective temperature rising patterns in the respective heating zones are detected by N (e.g., 4×2) thermometers (e.g., 4 heater thermo-couples and 4 cascade thermo-couples) disposed in the respective heating zones, and the detection results are stored in a memory over all the heaters.

Subsequently, from the M×N patterns thus detected and stored, M×N transfer functions are approximately determined for obtaining a temperature output of an arbitrary heating zone against an input to an arbitrary heater. Thus, the respective transfer functions are input in a computer as a temperature system simulation model of a heating furnace.

In another preferred embodiment of the temperature control simulation apparatus of the invention, a temperature change in the heating furnace upon loading an object to be heat-treated is represented by changing the heat capacity of a simulation model over time, so that temperature control on the heating furnace under external disturbances can be simulated on the computer.

In a further preferred embodiment of the temperature control simulation apparatus or system of the invention, the temperature system simulation device input in a computer and the temperature controller provided for controlling the temperature of the heating furnace are mutually connected together. The temperature system simulation device input to the computer can be made a control target in the form of a virtual furnace in place of the actual object (e.g., the actual furnace) to be controlled by the temperature controller.

The present disclosure relates to subject matter contained in Japanese Patent Application No. 10-228770, filed Aug. 13, 1998, which is expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which:

FIG. 4 shows the content of each transfer function;

FIG. 5 is a graph showing a temperature change with a constant quantity of manipulation;

FIG. 6 is a graph showing the stepped response data before correction;

FIG. 7 is a graph showing the stepped response data after correction;

FIG. 8 is a graph showing the stepped response data after correction (1 zone alone);

FIG. 20(*b*) is a block diagram with another modified example of a model configuration;

FIG. 22 is an explanatory view of a heater control mode;

FIG. 23 is an explanatory view of a cascade control mode;

FIG. 33(*b*) is a graph showing one example of a process treatment performed by the vertical diffusion apparatus.

DESCRIPTION OF THE PREFERRED EMBODIMENTS

Figure 1:
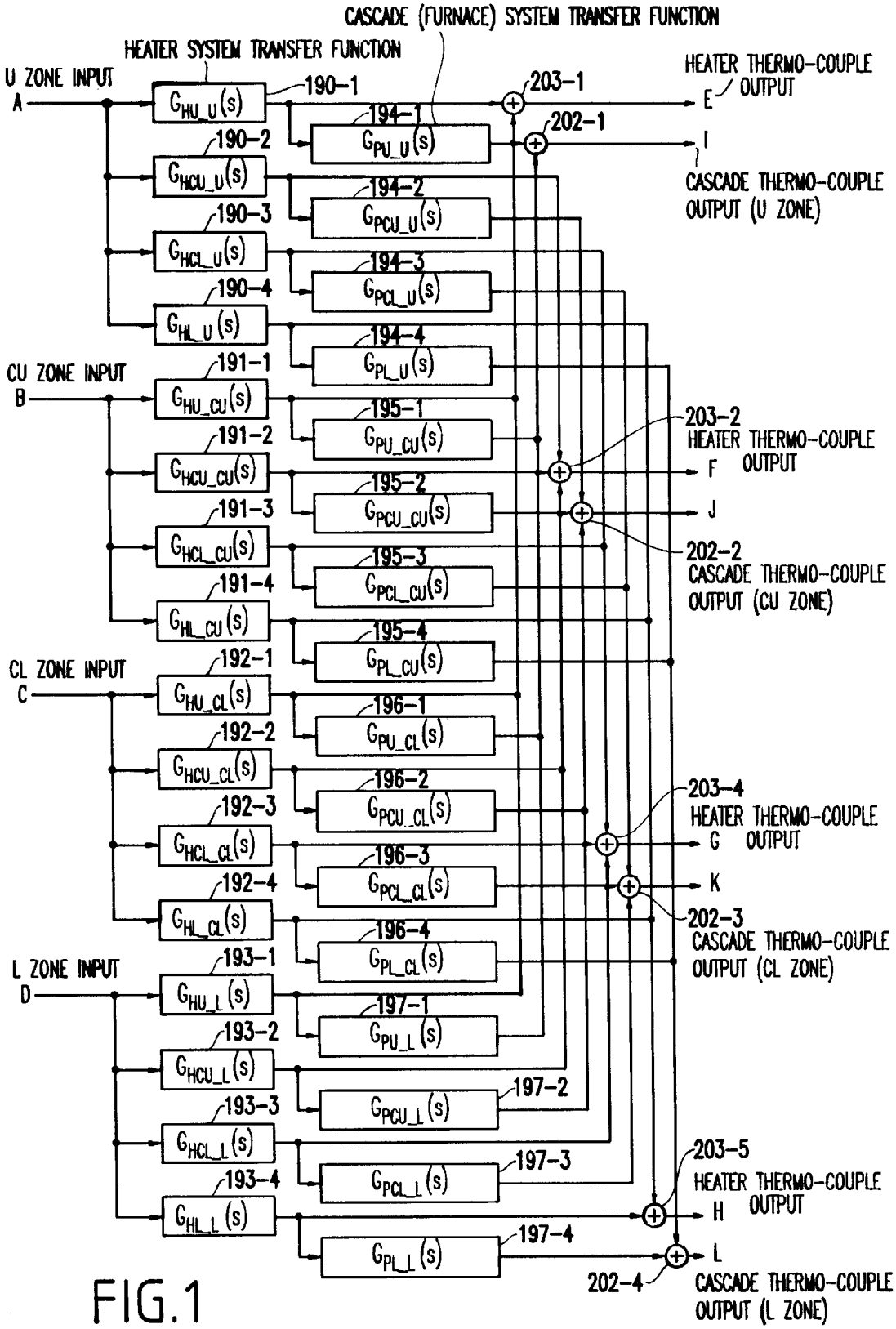
FIG. 1 is a schematic view of a temperature system simulation model.

Referring now to the drawings, and more particularly to FIGS. 1–33(*b*), there are shown preferred embodiments of the method and structures according to the present invention.

Figure 32:
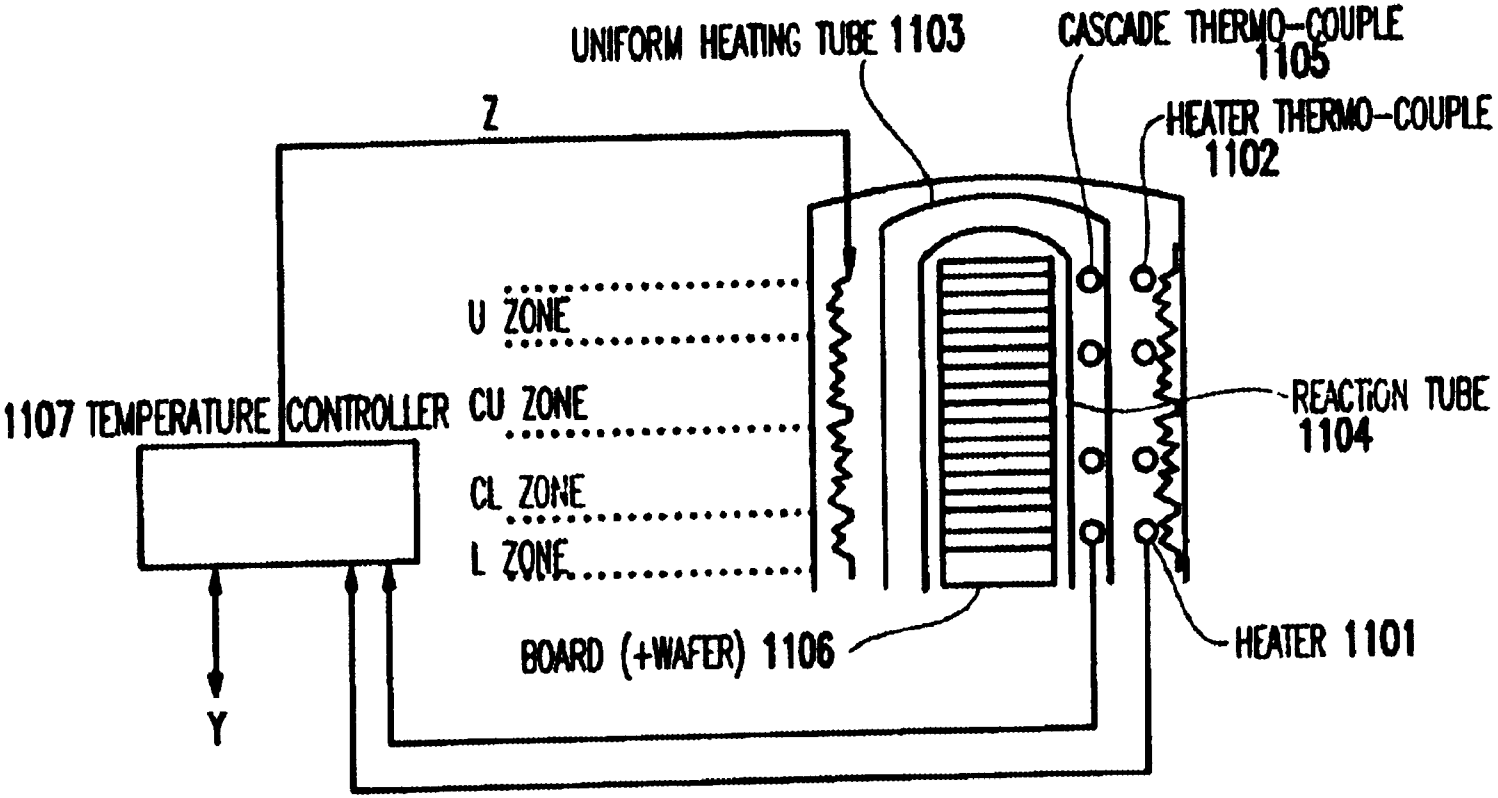
FIG.32 PRIOR ART
FIG. 32 shows an example of the structure of a vertical diffusion apparatus (including four zones)
Figure 33B:
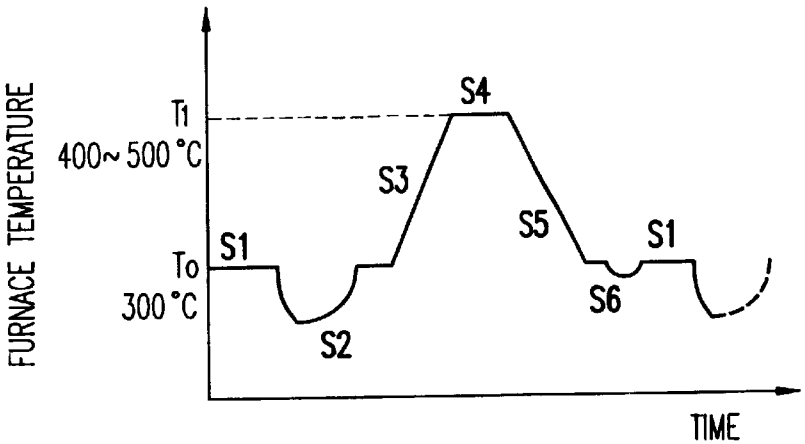
FIG. 33(*a*) is a flow chart showing one example of a process treatment performed by the vertical diffusion apparatus of FIG. 32.
Figure 33A:
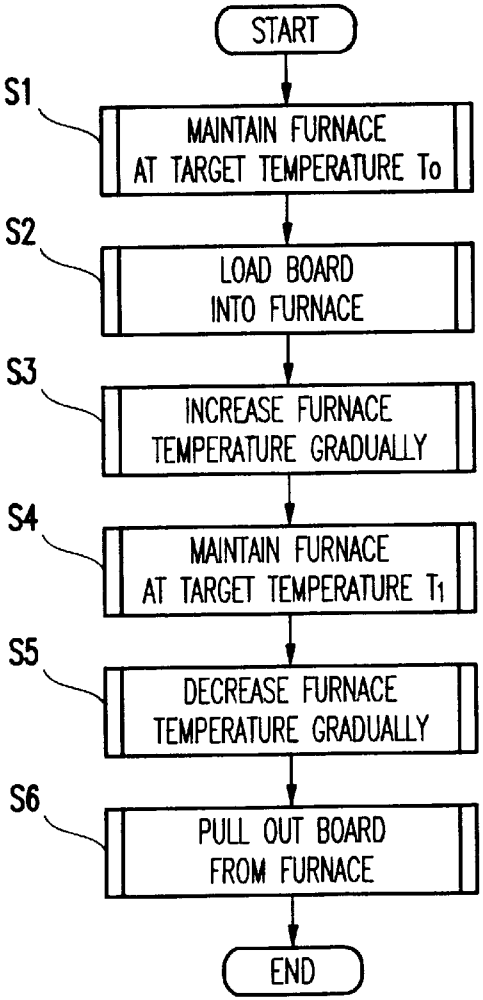

Throughout the accompanying drawings and the description which follows, a vertical diffusion apparatus (including four zones) as shown in FIG. 32 will be used as an example for explaining the present invention, but the present invention is also applicable to other types of furnaces such as electric furnaces, gas furnaces, steam furnaces, etc.

First Embodiment

FIG. 1 shows the outline of a temperature system simulation model adapted to be mounted on a temperature system simulation device according to the invention.

In FIG. 1, reference numerals 190-1 through 193-4 designate transfer functions of a heater system, and reference numerals 194-1 through 197-4 designate transfer functions of a furnace system (e.g., a cascade system).

Also, heater inputs A, B, C and D correspond respectively to quantities of manipulations or manipulation variables (e.g., values of electric power) sent from the temperature controller 1107 to the heaters 1101 of FIG. 32.

Similarly, heater outputs E, F, G and H correspond respectively to output temperatures from the heater thermo-couples 1102 of FIG. 32, and furnace temperature outputs I, J, K and L correspond respectively to the output temperatures from the cascade thermo-couples 1105 of FIG. 32.

As can be seen from the exemplified structure of FIG. 32, the result of an input to the heater 1101 in each zone influences not only the corresponding input zone but also the output temperatures of heater thermo-couples 1102 and cascade thermo-couples 1105 of the other zones. Therefore, the transfer functions 190-1 through 193-4 of the heater system and the transfer functions 194-1 through 197-4 of the furnace system are constructed in the form of a matrix while taking into account interference with other zones.

Specifically, in FIG. 1, G shows a transfer function, and a suffix H indicates a heater system, and a suffix P indicates a furnace system. Moreover, U, CU, CL and L designate respective zones, with the zone in front of "_" indicating an output-side zone, and the zone behind "_" indicating an input-side zone.

For instance, a transfer function $G_H$u_u(S) 190-1 of the heater system is indicative of a relation in which an input to the U zone exerts an influence on an output E of the heater thermo-couple in the U zone, and a transfer function $G_H$cu_u(S) 190-2 of the heater system is indicative of a relation in which an input to the U zone exerts an influence on a heater thermo-couple output in the CU zone.

Figures 2, 3:
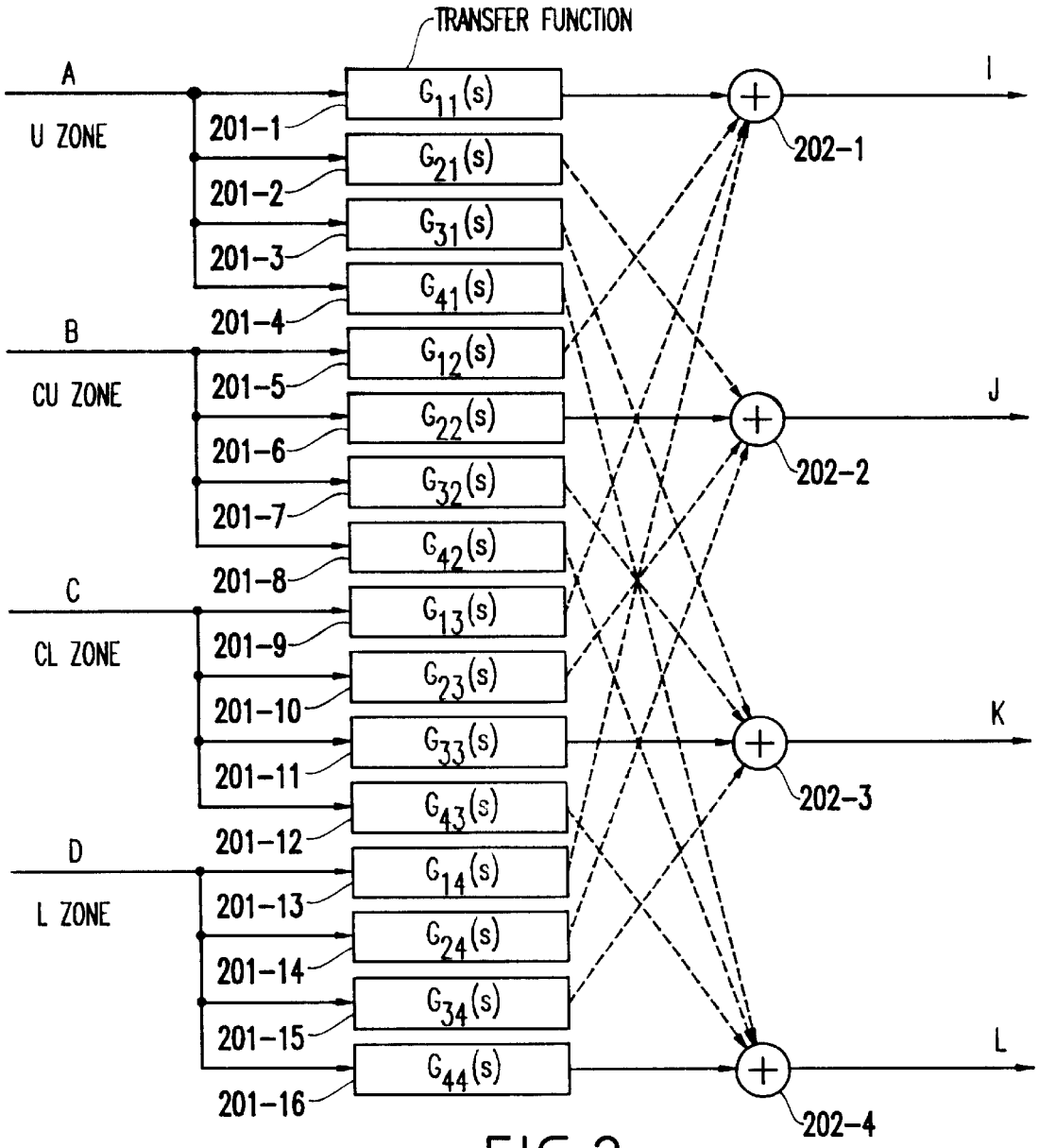
FIG. 2 is a block diagram which shows a series type transfer function including heater system transfer function and a furnace system transfer function.
FIG. 3 shows an input/output relation of the model shown in FIG. 2 by way of a matrix.

FIG. 2 shows a construction when series-type or serial transfer functions of the heater system and the furnace system are represented by transfer functions Gij, one for each zone of the heater system and the furnace system.

In FIG. 2, a transfer function Gij is obtained by multiplication of one of the serially arranged heater system transfer functions 190-1 to 193-4 and the corresponding one of the serially arranged cascade system transfer functions 194-1 to 197-4, as shown in FIG. 1, and hence given by the following equation:

$$Gij=G_H ij \cdot G_P ij$$

where j indicates an input zone, i indicates an output zone, and H and P indicate a heater system and a furnace system (e.g., cascade system), respectively.

As described above, with this arrangement, inputs A, B, C and D to the respective zones are respectively converted by transfer function blocks 201-1, 201-2, . . . , 201-15, 201-16 of the respective zones (U, CU, CL, L), and the conversion results are added in each zone by adders 202-1, 202-2, 202-3, 202-4, respectively, to provide respective zone outputs I, J, K and L.

Also, the heater thermo-couple outputs E through H become the outputs of the adders 203-1 through 2034, respectively, as shown in FIG. 1. With the arrangement as shown in FIG. 2, the output temperature (cascade thermo-couple output) in each zone is influenced by the inputs of all zones, as in an actual furnace.

For instance, the output I of the U zone is given by the adder 202-1 which adds the result of conversion of the input A of the U zone through the transfer function block 201-1, the result of conversion of the input B of the CU zone through the transfer function block 201-5, the result of conversion of the input C of the CL zone through the transfer function block 201-9, and the result of conversion of the input D of the L zone through the transfer function block 201-13.

This relationship is expressed by a matrix shown in FIG. 3 using the transfer function Gij.

Next, the transfer functions shown in FIG. 1 will be explained. FIG. 4 shows the content of each transfer function.

As well known in the field of control engineering, each transfer function in this apparatus can be approximated by a transfer function called "a first order time lag or delay+a dead time system", as shown in FIG. 4, and contains three parameters comprising a gain (K), a time constant (T) and a dead time (L).

The gain indicates a quantity of change against a unit input. The time constant indicates a period of time from the beginning of the unit input until the time when the output has changed to about 63% of the gain. The dead time indicates a non-reaction time from the beginning of the unit input until the time when the output has started to change.

As shown in FIGS. 2 and 3, there are sixteen (4×4=16) transfer functions in each of the furnace system and the heater system, and the above-mentioned three parameters in each transfer function should be determined from a relationship between the input and the output in each transfer function.

The above-mentioned simulation model can be formed using commercially available general-purpose software for control-system design, and simulation can be done by specifying the parameters. That is, it is possible to execute the simulation, by giving the parameters such as the gain, etc., to the transfer function block, and connecting the input and output blocks thereof.

Next, a description is given of determining the parameters while referring to a practical example.

First, temperature data is acquired using an actual apparatus. The acquired data comprises five kinds of data including first to fourth stepped response data (U, CU, CL and L, one for each zone) for steps (1) through (4), and a fifth constant manipulation data corresponding to a fifth step obtained by an open loop, with measurements being effected at all measuring points for both the heater thermo-couples and cascade thermo-couples.

The stepped response data is acquired by a temperature change when a quantity of manipulation (amounting to several percentage points) in the steady or stabilized state is added in one zone. In this case, the temperature is not completely stabilized due to variations in power supply.

In addition, for the quantity of manipulation in the steady state, a quantity of manipulation in the closed loop at a fixed amount is used for about one hour. In the case of PID control, the output is not stabilized or settled if a differential operation or control (D operation) is performed, so there is no differential operation performed.

The smaller the change in the manipulation quantity, the greater the influence of errors. An appropriate quantity of manipulation is provided such that an expected temperature change is produced in a range from about 50 degrees C. to about 100 degrees C.

Because the characteristics of the temperature change in an electric furnace are different for respective temperature ranges, the parameters of the model have to be established for each temperature range.

In view of such temperature characteristics, the temperature data, when obtained using an actual apparatus, should be obtained for temperature ranges each of which is set to be as narrow as possible. For instance, it is preferable to set each temperature range from about 100 degrees C. to about 200 degrees C.

After one data set has been obtained, the quantity of manipulation should be returned to that of the steady state, and the following measurement should be taken after the temperature has been stabilized. Moreover, the stepped response data obtained in the open loop includes the influence of a change in the power supply, and thus should be corrected by using a temperature change with a constant quantity of manipulation.

The temperature data measured using the actual apparatus should be acquired at the same time zone or span (e.g., from 10:00 p.m. for 12 hours) in order to effect corrections thereof at the same time as the measurements of the actual temperature data were performed.

FIG. 5 shows an example of the temperature change with a constant quantity of manipulation.

If the beginning of a stepped input is 10:00 p.m., in parallel with this, the relationship between the time and the amount of temperature change is acquired with the constant quantity of manipulation, based on the temperature at 10:00 p.m. For instance, when the temperatures at 10:00 p.m. and 11:00 p.m with a constant quantity of manipulation are 400 degrees C. and 390 degrees C., respectively, the temperature at 11:00 p.m. of the stepped response data is corrected by addition thereto of (400−390)=10 degrees C.

FIG. 6 shows the temperature change from the stepped response data before a unit input is supplied (i.e., the state in which the furnace temperature is stable, e.g., at 500 degrees C.) to that after the unit input is supplied in which the quantity of manipulation in the CU zone is increased by a unit input of 1% at 10:00 p.m. FIG. 7 shows the stepped response data after corrections (i.e., the results of corrections in which the temperature change over time with the constant manipulation quantity as shown in FIG. 5, being calculated at predetermined time intervals) is sequentially added to the initial temperature from the beginning of the stepped response shown in FIG. 6 (e.g., subtracted from the initial temperature so as to cancel the amount of change in the power supply).

Similarly, the data shown in FIGS. 5 through 7 are acquired in the other zones (U, CL and L), respectively.

Next, parameters (e.g., gain, time constant and dead time) of the model (transfer function) are determined from the acquired data. Each transfer function of the entire system of this model takes the form of a serial connection of the heater system transfer function and the furnace system transfer function, as shown in the formula (1), and hence, the parameters of the heater system transfer function are first determined, and then the parameters of the furnace system transfer function are determined.

FIG. 8 shows the stepped response (only in the CU zone) after the above corrections. As shown in FIG. 8, the temperature gain is an average within a range in which the change becomes relatively small. The reason for taking the gain as the average is to decrease errors, and the average temperature gain is 46.75 E in FIG. 8.

The dead time is defined as a period of time from the beginning of the stepped input to the time when the heater temperature begins to change. It is preferred that the dead time, though its clear definition is difficult due to error, not be more than about three minutes. This is because a long dead time makes the influence of interference unnatural (i.e., causes ragged or irregular changes). Here, the dead time of 0.5 minutes was obtained before the temperature begins to rise.

The time constant is the period of time required for the temperature gain to reach 63% of the above-mentioned temperature gain 46.75 EC (precisely, the dead time is subtracted therefrom): Thus, the time constant obtained herein is 167 minutes. In this manner, $G_H$cu_cu(S) is determined.

The parameters of all the transfer functions of the heater system are similarly determined in the above manner.

In this case, because data in the open loop may still contain errors such as a change in the power supply, etc., the parameters thus obtained are adjusted by referring to the closed loop data which are acquired by effecting closed loop control such as PID control while using an actual apparatus.

The closed-loop data, which are referred to may be the stepped response data, etc., which are obtained in the temperature range in which the model parameters are determined, being added by +100 degrees C., and the parameters thus obtained are adjusted through comparison with the result of simulating the model with the heater system alone in the closed loop. For instance, if the open loop data is acquired at 500 degrees C. with a constant quantity of manipulation, the condition required of the closed loop data is the stepped response from 450 degrees C. to 550 degrees C.

A temperature controller operating similarly to the temperature controller actually used is formed virtually on a computer, and simulation is performed with a target temperature being given to the virtual controller as when the closed loop data was acquired.

The parameter(s) to be adjusted is primarily the time constant, whereas the dead time is subjected to a fine control alone, and the gain, which results after the lapse of a long time period, is usually not subject to adjustment other than the time when adjustment is apparently required, i.e., when the target value cannot be reached because of a small gain.

The time constant is adjusted so that if it is slower or quicker than the temperature data obtained with the actual apparatus, the main or primary factors such as (U→U, CU→CU, etc.) are made smaller or greater, respectively.

On the other hand, when interference from other heat zones is so great that the error due to interference does not decrease with the adjustment of the main or primary factors alone, the auxiliary or secondary factors (U→CU and CU→U, etc.) are adjusted to be smaller or greater, respectively, in relation to the level of the interference. For instance, in FIG. 2, the output of each zone is the sum of the outputs of the respective transfer functions, and this output is compared with actual data so that a difference between them is adjusted.

At this time, outputs before addition, i.e., the outputs of the respective transfer functions are observed so as to determine parameters of which transfer function are to be adjusted. This is done, for instance by storing the results of observation as data, or by displaying them in a graph.

As a result, a transfer function is specified which appears to be a main cause for the differences between the virtual values and the actual measured values, and the time constant of that transfer function is adjusted.

As an example, the observation of the respective transfer function outputs upon adjustment of the heater system U zones has revealed that the virtual or theoretically calculated data is quicker than the actual or measured data because of large outputs (interference) of the transfer functions in the CU zones. Accordingly, the time constant was increased by 1.5 times but still gave a quicker response than the actual data, so successive increases in the time constant by 2, 2.5 and 3 times were made, until finally an increase of 3 times effectively reduced the error to an acceptable level.

Regarding the dead time, the time from an input until the temperature begins to rise is observed, and if the simulation result is slower than the actual data, the dead time of the main or primary transfer function of the zone is shortened or vice versa.

Also, when the reaction becomes ragged or irregular due to the influence of interference, appearing when the dead time is too long, the dead time of the auxiliary or secondary transfer function is shortened.

The gain, which is due to a long time period, is not adjusted unless clearly required.

When the gain is so small that the target value is not reached, the gain of the main or primary transfer function and/or the gain of the auxiliary or secondary transfer function in the related zone is increased by about 10 to 20% (i.e., the amount of error).

Moreover, the open loop data may be the cause of an error, so it is obtained again. The open loop data is obtained again because of the possibility that the open loop data may contain errors such as power supply variations, unmeasurable errors, or in some cases data acquisition mistakes.

The parameters of the transfer function of the heater system are determined in the above manner.

Next, the parameters of the transfer function of the furnace system are determined. The parameters of the transfer function of the furnace system are determined from the transfer function parameters of the entire control system which are obtained in the same manner as in the parameters of the transfer function of the heater system, while using the heater system transfer function parameters already obtained.

The gain of the transfer function of the entire control system is determined from the corrected stepped response data in the same manner as in the gain of the transfer function of the heater system. Similarly to the heater system, an average within the range where a change is relatively small is first determined, and then divided by the gain of the heater system to provide the gain of the furnace system. This is because the transfer function of the entire control system is composed of the transfer function of the heater system and the transfer function of the furnace system which is disposed thereafter and connected in series therewith, as shown in FIG. 1. For instance, let the gain of the heater system be 40 and the gain of the entire control system be 50, then the gain of the furnace system is 50/40=1.25.

At this time, in both the transfer function of the heater system and the transfer function of the furnace system, the same relation from the input zone to the output zone is used. For instance, when the gain from the U zone to the CU zone of the furnace system is determined, the gain from the U zone to the CU zone of the heater system is used.

The dead time of the furnace system is obtained by subtracting the dead time of the heater system from the time beginning with an input until the time the temperature of the furnace begins to change. In this case, the same relation between the input zone and the output zone is used.

The time constant is obtained on a trial basis while comparing the open loop stepped response result determined by computer simulation with the corrected stepped response data (open loop data) obtained by using an actual apparatus. That is, the time constant of the matrix transfer function of the furnace system is obtained while comparing the open loop data with the simulation result.

Given what is considered to be a slightly large value as an initial value, the stepped response with a quantity of manipulation of plus several percentage points is simulated as in the open loop data. Then, the time constant is gradually adjusted to be smaller and smaller while comparing this result with the open loop data, so as to determine a final value.

Although the initial value of the time constant varies depending upon the characteristic of the object to be controlled, the time constant is in proportion to the heat capacity and hence determined while taking account of the structural characteristic of the object to be controlled. In this practical example, the time constant of the transfer function of the heater system is determined to be 167 minutes, and thus the time constant of the furnace system becomes considerably small in comparison with the heater system. Accordingly, the time constant was initially set to ten minutes, and finally determined to be 2 minutes according to the aforesaid cut and try process (e.g., trial basis).

Figure 12:
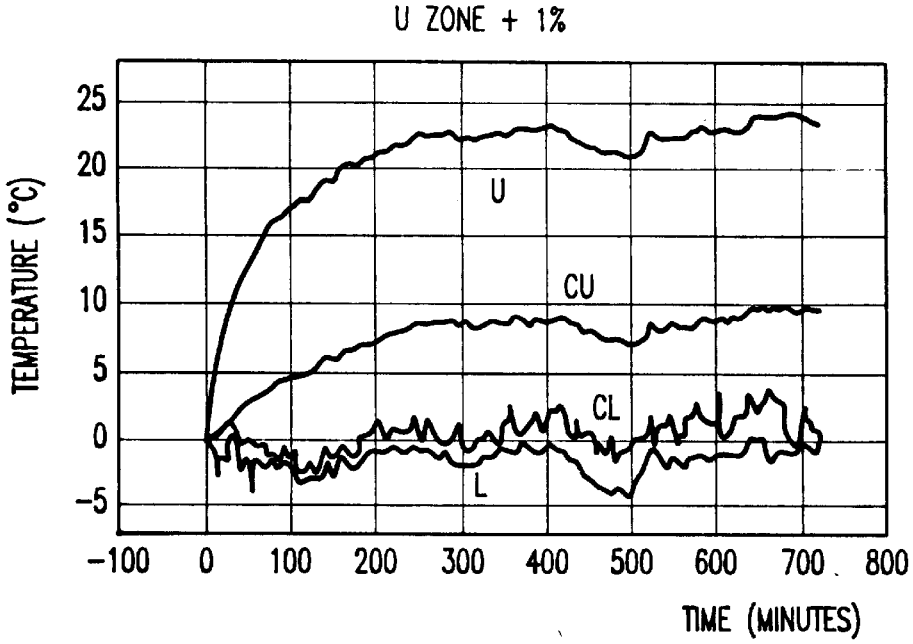
FIG. 12 is a graph with data representative of the heater system transfer function in a U zone.
Figure 13:
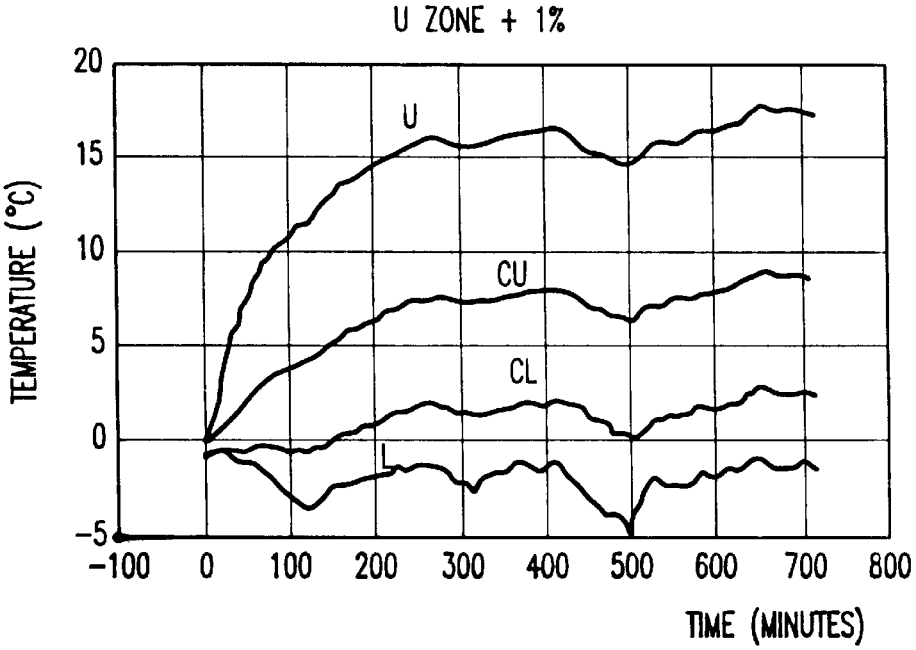
FIG. 13 is a graph with data representative of the series transfer functions of the heater system and the furnace system in the U zone.

For instance, the FIGS. 12, 13, described in detail later, show the temperature changes in the respective zones in the heater system and the entire system, respectively, when a quantity of manipulation of +1% is added in the U zone under the open loop control.

In this case, the U—U gain of the furnace system in the U zone is calculated in a series of steps. First, the gain of the entire system is determined to be 16.19 by averaging the gain in a range in which the temperature change becomes small, as shown in FIG. 13. The entire system gain of 16.19 is then divided by the gain of the heater system of 22.6, thus providing 0.7163 as the U—U gain of the furnace system in the U zone.

The dead time of the furnace system is calculated to be 0.2 minutes by subtracting the dead time of the heater system of 0.4 minutes from an approximate time of 0.6 minutes which is the time from the beginning of an input until the furnace temperature begins to rise.

The model was set with an initial value of the time constant of 5 minutes (this value is later adjusted and hence may be any appropriate value) as compared with an initial value of 55 minutes of the heater system. The model thus set is subjected to simulation under open loop control.

The output of the model is compared with the actually measured value, and if the response of the model output is quicker than the measured value, the time constant is increased, whereas if the model response is slower than the measured value, the time constant is decreased.

In this example, the time constant of 5 minutes was large and successively adjusted to 4 minutes, 3 minutes, and so on, with the result that the difference between the model output and the measured value is reduced to an allowable tolerance level when the time constant was set to 1 minute. Thus, the time constant was set to this value.

Lastly, similar to the transfer function of the heater system, the parameter adjustment is done comparing the closed-loop data. This completes the calculations of the transfer function parameters. However, it is necessary to calculate the parameters for each condition for executing a simulation because they vary depending upon the temperature ranges, the process conditions and the respective devices.

Although the method for determining the parameters of the transfer function was explained using a practical example, the transfer function, which shows the relation between the input and the output, can be corrected or replaced with any appropriate method which can determine the input-to-output relation more accurately.

It is also possible to replace the transfer function with an appropriate equation of state based on contemporary control theory.

Figure 9:
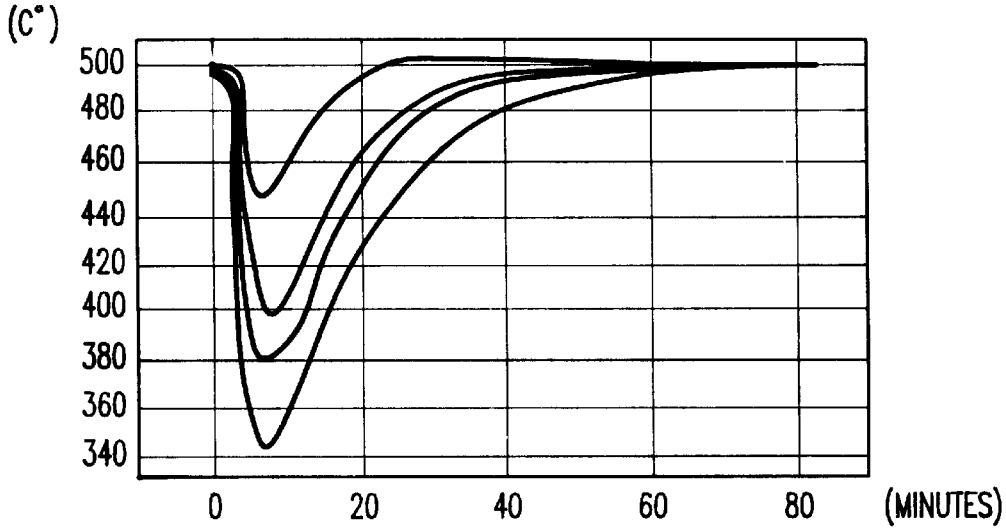
FIG. 9 is a graph showing the temperature change in the furnace during boat loading.

Next, a simulation of the temperature change during boat loading will be discussed because one of the operations required for temperature control is the reduction of settling time upon boat loading. FIG. 9 shows an example of the temperature change in the furnace during boat loading.

The major cause of temperature change upon boat loading is that a boat with a mounted wafer is at room temperature when loaded or inserted into the furnace having a stable temperature. That is, there is an increase in the total heat capacity of the furnace including the wafer mounted boat. Thus, the time constant of the transfer function will be changed (to increase) over time to express an increase in the heat capacity with a model.

Figure 10:
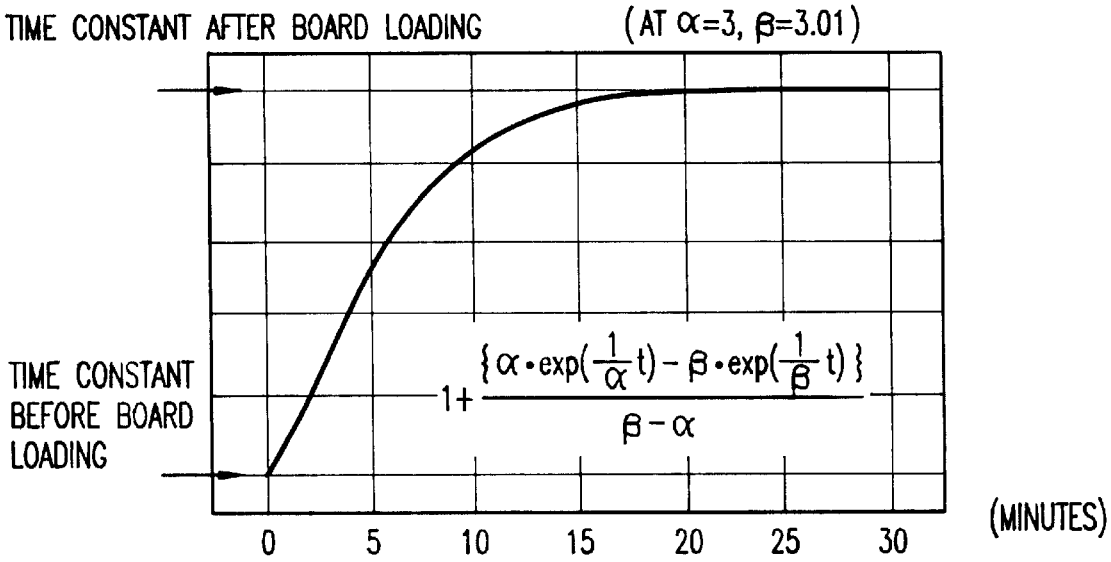
FIG. 10 shows a time change pattern of a time constant.

FIG. 10 shows a pattern of the temperature change over time. As shown FIG. 10, if it is assumed that the pattern of the time change is a second order delay curve (3), and that a time constant after the boat loading is Ta, and that a time constant before the boat loading is Tb, then a time constant T during boat loading is calculated according to the following formula (4):

$$1+(\alpha\cdot\exp(-t/\alpha)-\beta\cdot\exp(-t/\beta))/(\beta-\alpha) \quad (3)$$

$$T=(Ta-Tb)\times[1+(\alpha\cdot\exp(-t/\alpha)-\beta\cdot\exp(-t/\beta))\ (\beta-\alpha)]+Tb \quad (4)$$

Here, note that Ta is the value of the time constant when the transfer function is determined, i.e., when the boat is inserted or loaded, and is a known value, so unknown values in the formula (4) above are Tb, $\alpha$ and $\beta$. These values Tb, $\alpha$ and $\beta$ are determined by using the data when the boat has actually been loaded.

When the temperature decrease during the boat loading is large, the value of Tb is made smaller in comparison with Ta. That is, the amount of change (Ta−Tb) is made greater, but on the contrary, when the temperature decrease is small, the value of Tb is made not as small in comparison with Ta. In other words, the amount of change (Ta−Tb) is reduced.

The paramaters $\alpha$ and $\beta$ each represent the speed of change in the temperature decrease, and when they are large, the change is slow, and conversely when small, the change is fast.

In view of the above, Tb, $\alpha$ and $\beta$ are determined by the cut-and-try method (e.g., trial basis) while comparing the actual data with the simulation result.

The change pattern over time of the time constant was approximated by the second order delay curve to smooth the change in the angle or slope at the beginning and end of the process and to bring the change in the heat capacity to a substantially constant speed (with the movement of the boat being at a constant speed), thus approximating the actual operation in the simulation. The model at the time of boat loading was constructed using the time constant thus determined.

To model the furnace construction of FIG. 32, the thermo-couple output from the model requires the heater thermo-couple output and the cascade thermo-couple output.

Figure 20A:
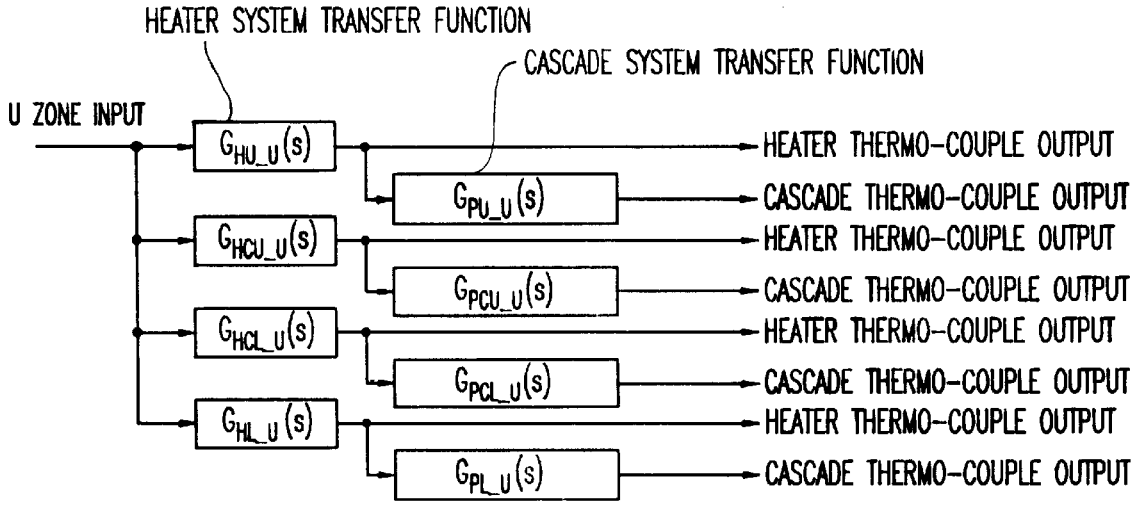
FIG. 20(*a*) is a block diagram with a modified example of a model configuration.
Figure 20B:
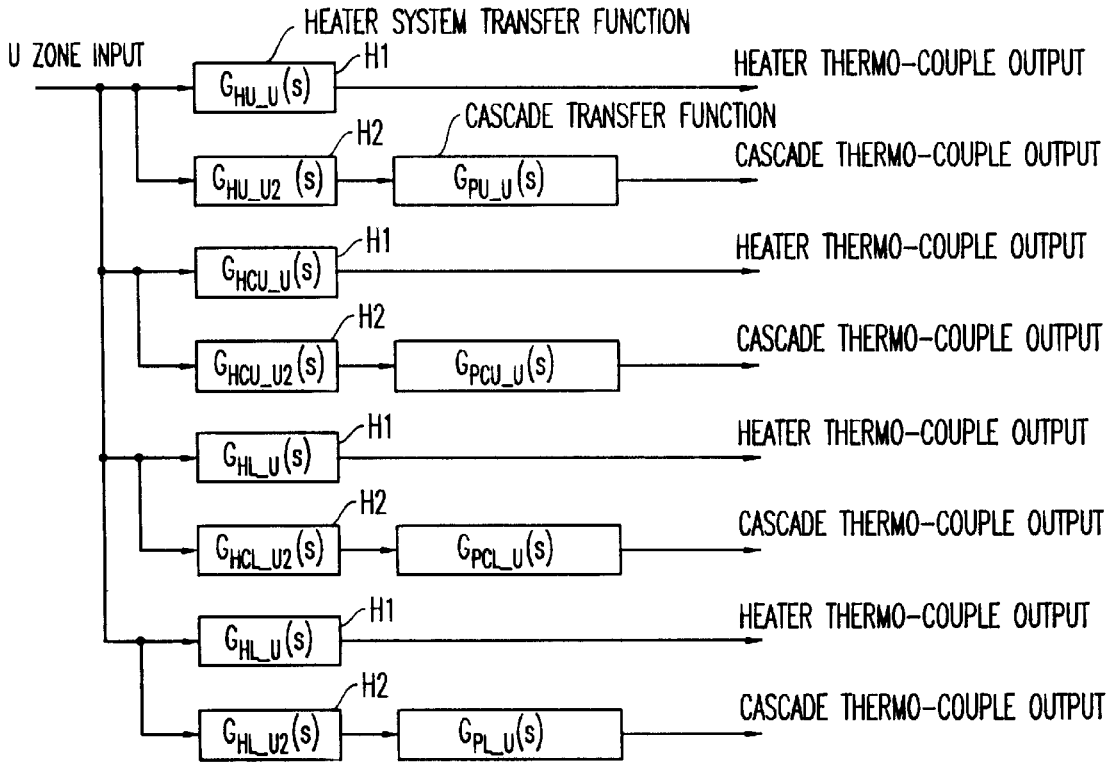

In general, the model can be represented by the construction as shown in FIG. 20(*a*) (similar to FIG. 1) in connection with the U zone alone. However, suppose that the time constant is required to change similar to the time of boat loading. In this case, with the construction of FIG. 20(*a*), when the time constant of the transfer function of the cascade system (furnace interior) is limited, the temperature decrease in the cascade thermo-couple output during the boat loading might not always be properly expressed even if only the time constant of the transfer function of the cascade system is changed.

Then, a model like FIG. 20(*b*) is employed although the construction would be somewhat complicated. In this model, it is assumed that the heater system transfer functions are in a parallel relation with respect to each other, and one of them is used as the output of the heater thermo-couple, whereas the other is connected with the transfer function of the cascade system so as to be employed as the output of the cascade thermo-couple.

In the construction of FIG. 20(*b*), the transfer function H2 of the heater system uses the same values as those of the heater system transfer function H1 with respect to the transfer function parameters (K, T, L), but different values with respect to the time change parameters (Tb, $\alpha$, $\beta$).

With such a construction, it is possible to adjust the time changes of the heater thermo-couple and the cascade thermo-couple independently of each other, so that even if the time constant of the transfer function of the cascade system is limited, it is possible to indicate the temperature decrease in the cascade thermo-couple output by changing the time constant of the transfer function H2 of the heater system and the transfer function of the cascade system over time.

Figure 21:
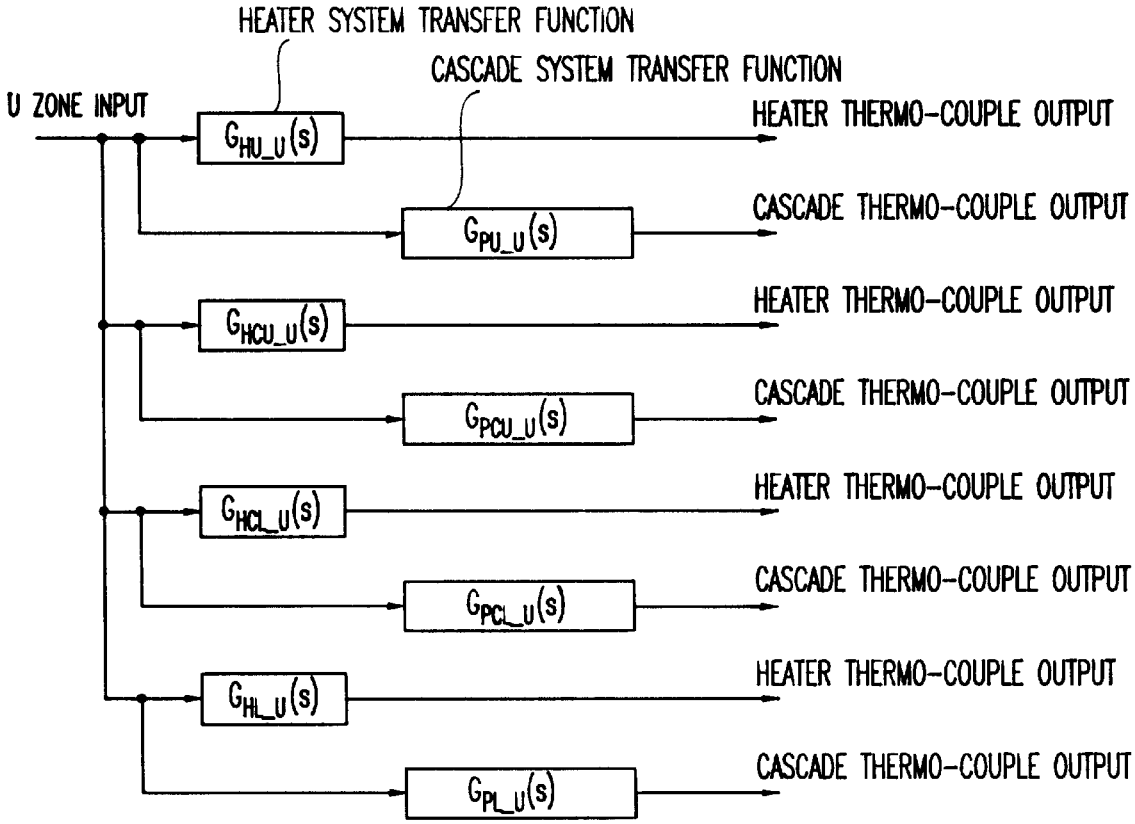
FIG. 21 is a block diagram which shows other modified examples of the model configuration.

If such a model is employed in which the transfer function of the cascade system is obtained directly from the measured temperature of the cascade thermo-couple without using the transfer function of the heater system, it is illustrated as in FIG. 21.

Moreover, the two models mentioned above, although having been applied to boat loading, are applicable to other operations.

Next, the way the time change parameters are determined will be explained. The parameter decision procedure at the time of boat loading is explained first. (1) First, during boat loading, data is acquired in a heater control mode. (2) Second, the time change parameters of the transfer function H1 of the heater system are determined while comparing the data acquired and the simulation result (i.e., under control of the heater system according to the heater control mode). (3) Third, the data during the boat loading is acquired in the cascade control mode to be described later. (4) Fourth, the time change parameters of the heater system transfer function H2 and the cascade system transfer function are determined while comparing the acquired data and the simulation result (obtained with the furnace system being controlled in the cascade control mode).

The above-mentioned heater control mode and the cascade control mode will be explained below. FIG. 22 illustrates the heater control mode. FIG. 22 refers to symbols and corresponding parts or elements as in FIG. 32. The heater control mode is for controlling the temperature of the heater thermo-couple. (The temperature of the cascade thermo-couple can be measured but not used for the purpose of control.) A quantity of manipulation of the heater is obtained by subtracting the temperature of the heater thermo-couple from a set temperature Y, followed by a PID processing operation. The temperature change caused by the boat loading under the heater control mode is shown in FIG. 24 with respect to the CU zone only.

The temperature of the cascade thermo-couple, not being controlled, had drastically dropped upon loading of the boat into the furnace, but was gradually recovered to the initial temperature and stabilized with the passage of time.

Figure 24:
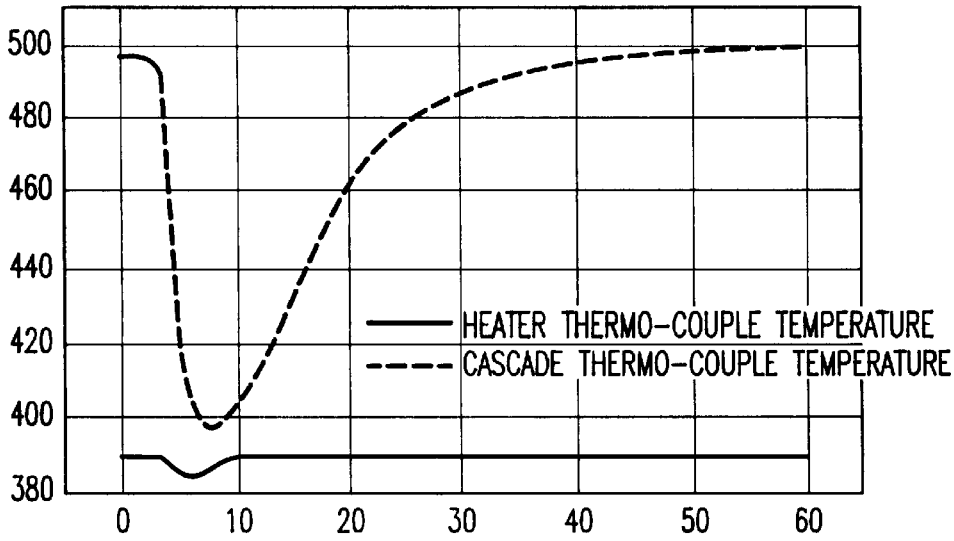
FIG. 24 is a graph depicting a temperature change during boat loading in a heater control mode.
Figure 25:
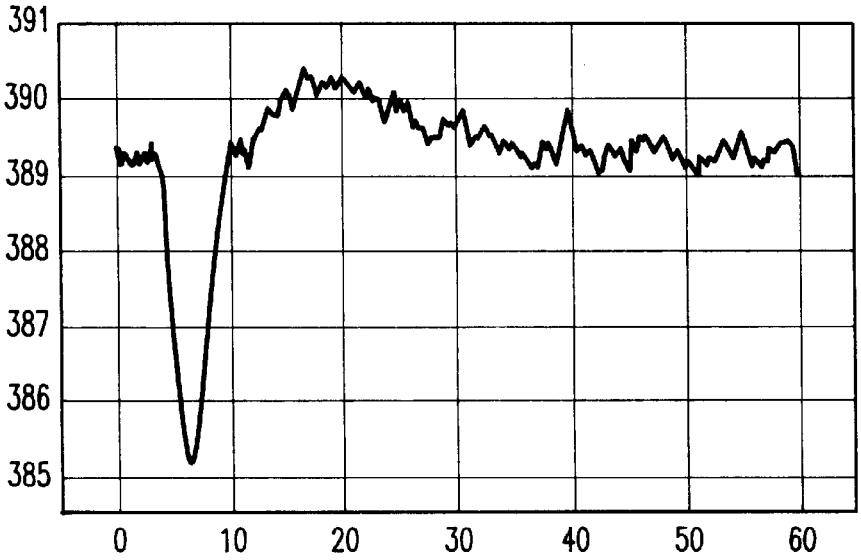
FIG. 25 is a graph depicting a temperature change during boat loading in the heater control mode.

FIG. 25 is a view similar to FIG. 24 but with only the temperature of the heater thermo-couple of FIG. 24 being expanded. In FIG. 25, the heater thermo-couple is located at a distance from the wafer, so the temperature decrease due to boat loading is limited. The time change parameters of the transfer function H1 of the heater system are determined from the temperature change of the heater thermo-couple, as shown in FIG. 25, according to procedure (2) mentioned above.

Next, the cascade control mode will be explained. FIG. 23 illustrates the cascade control mode. In FIG. 23, like symbols are employed to designate like or corresponding parts or elements of FIG. 32.

With the cascade control mode, a quantity of manipulation for the heater is given by the value which is subtracted by the temperature of the cascade thermo-couple from set temperature Y, then subjected to the PID processing operation, again subtracted by the temperature of the heater thermo-couple, and further subjected to the PID processing operation.

The temperature in the furnace can be controlled by using the cascade control mode. The heater control mode is required because the cascade thermo-couple cannot be used because of the adhesion of a reactant gas to the cascade thermo-couple, and therefore control has to be effected by the heater thermo-couple alone.

Figure 26:
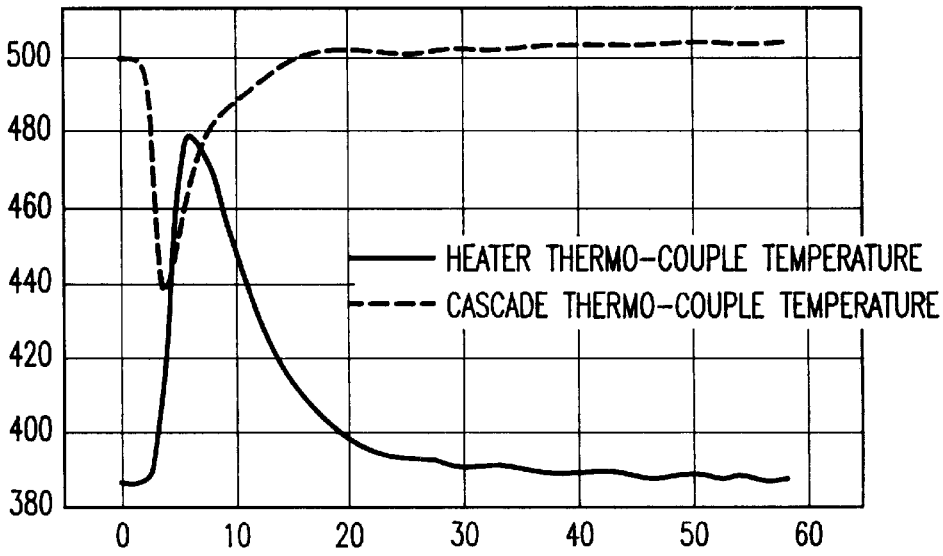
FIG. 26 is a graph depicting a temperature change during boat loading in a cascade control mode.

FIG. 26 shows a temperature change in the CU zone alone during the boat loading according to the cascade control mode. The temperature decrease of the cascade thermo-couple has become smaller as compared with the heater control mode because the temperature of the cascade thermo-couple is controlled. Also, the temperature of the heater thermo-couple is controlled using the result of the PID processing operation of the temperature of the cascade thermo-couple, so the temperature change of the heater thermo-couple differs from the temperature change in the heater control mode.

Thus, it is not possible to predict the influence of boat loading on the heater thermo-couple from the temperature change of the heater thermo-couple of FIG. 26. For this reason, in above-mentioned procedures (1) and (2), the change parameter of the transfer function H1 of the heater system is determined by using data in the heater control mode.

Figure 27:
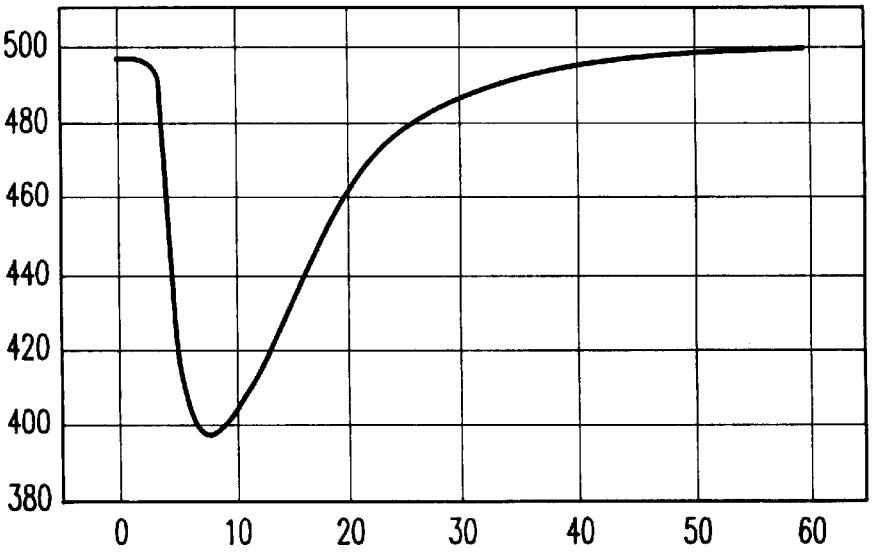
FIG. 27 is a graph depicting a temperature change during boat loading in the cascade control mode.
Figure 28A:
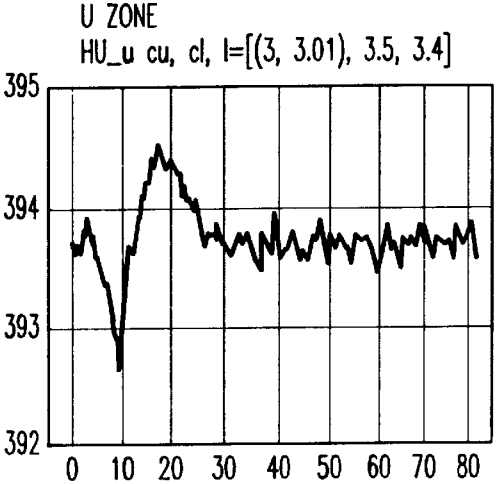
FIGS. 28(*a*) to 28(*d*) show a temperature change during the boat loading in the heater control mode and time change parameters in each zone.
Figure 28B:
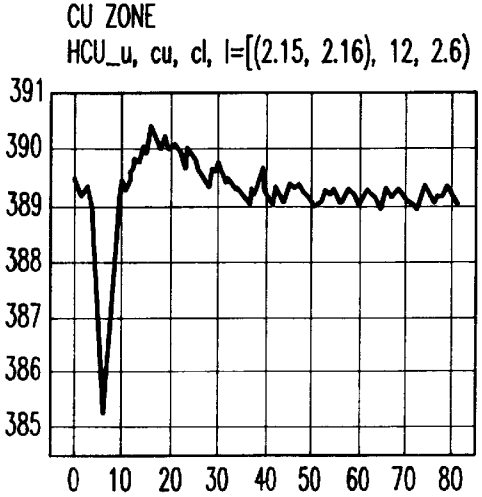
Figure 28C:
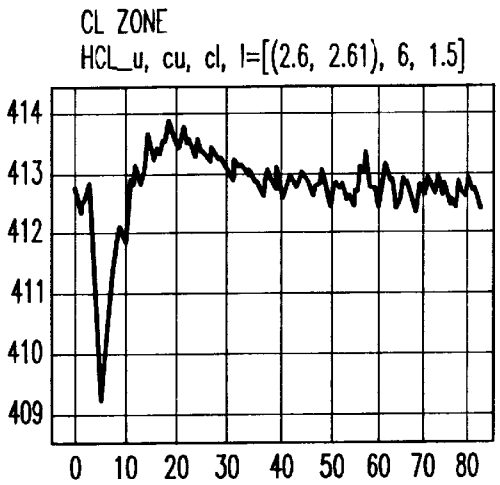
Figure 28D:
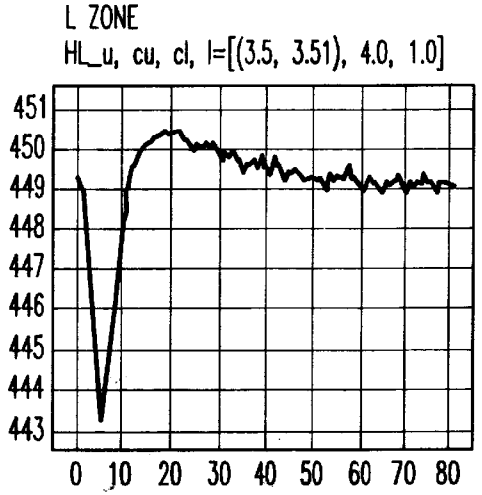
Figure 29A:
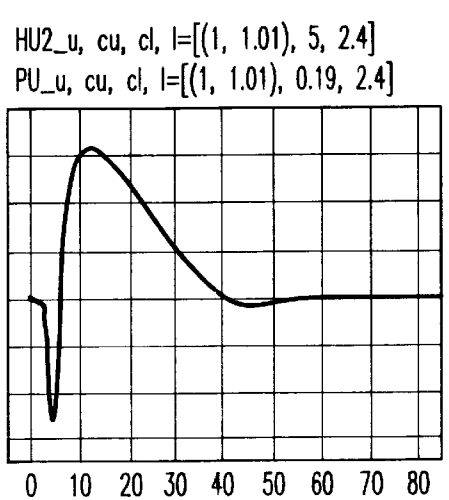
FIGS. 29(*a*) to 29(*d*) show a temperature change during the boat loading in the cascade control mode and time change parameters in each zone.
Figure 29B:
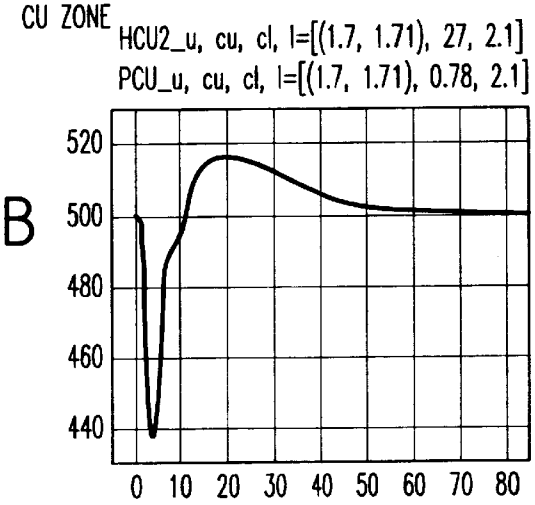
Figure 29C:
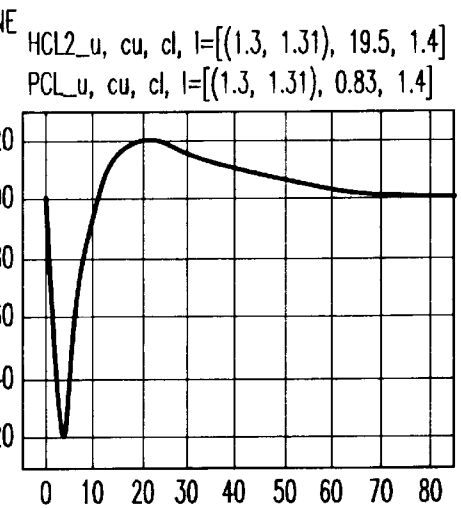
Figure 29D:
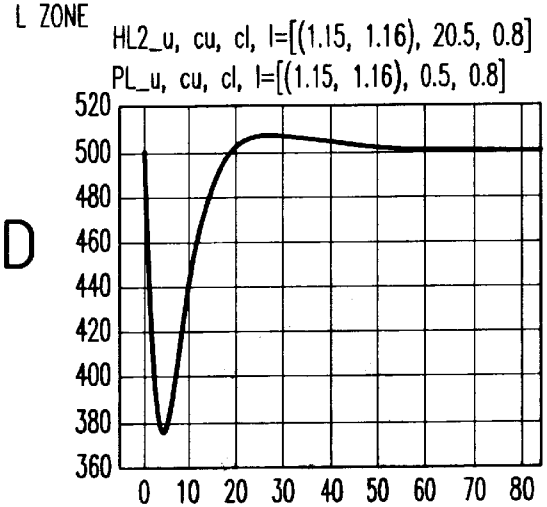

FIG. 27 is a view similar to FIG. 26 with only the temperature of the cascade thermo-couple therein being expanded. The time change parameters of the heater system transfer function H2 and the cascade system transfer function are determined from this temperature change according to the fourth procedure mentioned above.

Among these two transfer functions, the parameters are first determined by changing the time constant of the transfer function H2 of the heater system. Then, using the parameters of the heater system transfer function H2, the parameters are determined by changing the time constant of the cascade system transfer function.

The way in which the parameters for the time changes of the two transfer functions are determined is that a general temperature change is first represented by the heater system transfer function H2, followed by fine tuning adjustments by the cascade transfer function. In some cases, the heater system transfer function H2 may be adjusted again.

One example of the time change parameter is shown below.

Example of the Time Change Parameters (in the CU zone alone)

(Ta−Tb) and (α, β)

(the heater system transfer function H1)

HU_cu=3.5, (3, 3.01)

HCU_cu=12, (2.15, 2.16)

HCL_cu=6, (2.6, 2.61)

HL_cu=4.8 and (3.5, 3.51) (the transfer function H2 of the heater system)

HU_cu2=5, (1, 1.01)

HCU_cu2=27, (1.7, 1.71)

HCL_cu2=19.5, (1.3, 1.31)

HL_cu2=20.5 and (1.15, 1.16) (the cascade system transfer function)

PU_cu=0.19, (1, 1.01)

PCU_cu=0.78, (1,7, 1.71)

PCL_cu=0.83, (1.3, 1.31)

PL_cu=0.5, (1.15, 1.16)

Determining the above parameters is explained below.

FIGS. 28(*a*)–28(*d*) show the temperature change (only for the heater thermo-couple) during boat loading in the heater control mode, and the time change parameters obtained for that period.

It should be noted, for example, that the expression "U zone HU_u, cu, cl, 1=[(3, 3.01), 3.5, 3.4]" means that the time change parameters of the transfer function, which are to be added as an output in the U zone of the heater system thermo-couple, are the time constant of change of (3, 3.01), the amount of the change (Ta−Tb) is 3.5, and the change-starting time is 3.4.

The way to determine the above parameters is that the time constant for change is obtained from the speed of change in the temperature decrease, and the amount of change is obtained from the magnitude of the temperature decrease, according to the trial basis (e.g., cut-and-try basis).

Then, the time change parameters of the heater system transfer function H2 and the cascade system transfer function are determined using the cascade control system data. FIGS. 29(*a*)–29(*d*) show the temperature change (for the cascade thermo-couple alone) during the boat loading in the cascade control mode, and the change parameters obtained at that time.

Here, similar to the above-mentioned heater control mode, it should be noted that the expression "U zone HU2_u, cu, cl=(1, 1.01), 5, 2.4, PU_u, cu, cl, 1=(1, 1.01), 0.19, 2.4" means that the time change parameters of the heater system transfer function H2, which are to be added as an output in the U zone of the cascade system thermo-couple, are the time constant of change of (1, 1.01), the amount of the change (Ta−Tb) is 5, and the change-starting time is 2.4. The time change parameters of the cascade system transfer function are the time constant of change of (1, 1.01), the amount of the change (Ta−Tb) is 0.19, and the change-starting time is 2.4.

The order for determining the parameters above is that the time change parameters of the heater system transfer function H2 are determined first with the above-mentioned heater system transfer function H1.

When the change in the simulation data becomes equal to the change in the measurement data by simply changing the time constant of the heater system transfer function H2, the time change parameters are determined, and the time constant of the cascade system transfer function is unchanged.

In the event the simulation result does not approach the measurement data while repeating the cut-and-try (trial) procedures, the time change parameters for the time constant of the cascade system transfer function are then determined. These time change parameters can be determined in the same manner as for the heater system transfer functions H1 and H2. However, the same value for the time constant is employed as with the heater system transfer function H2 for the sake of convenience of adjustment.

If a difference between the simulation data and the measurement data still exists, the time change parameter of the heater system transfer function H2 can be adjusted, but it is preferable that an appropriate value within a certain tolerance be used because the simulation result cannot completely match the measurement data.

In the above-mentioned cut-and-try procedure, the smaller the time constant of change, the faster change occurs, whereas the greater the time constant of change, the slower the change occurs. In these cases, the amount of change represents the magnitude of a temperature drop or decrease, so adjustments are performed while making a comparison between the simulation result and the measured data.

The time constant of change is obtained from the data obtained at the time the boat has been loaded into the furnace.

First of all, the time from the beginning of boat loading until the temperature of the furnace starts to decrease in each zone is determined. This time marks the beginning time of the time change of the furnace. Then, simulation is performed while setting the time constant of change (α, β) and the amount of change to their respective initial values.

To simulate the change in the time constant over a range of time, the time elapsed from the beginning of the boat loading is input to calculate the time constant at that time so that a second order delay function can be programmed which outputs the time constant thus calculated so as to be used by the transfer function. This is achieved by commercially-available software.

When adjustments are made according to the cut-and-try procedure, to the time constant, a value greater than 0 is used since the time constant should not be zero or less than zero.

Figure 30:
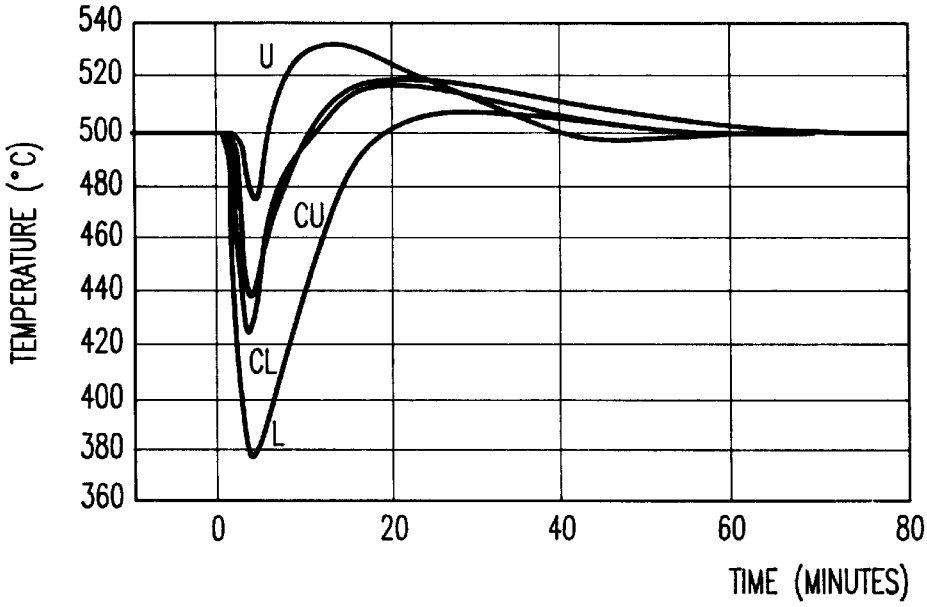
FIG. 30 shows the temperature of a cascade thermo-couple during boat loading.
Figure 31:
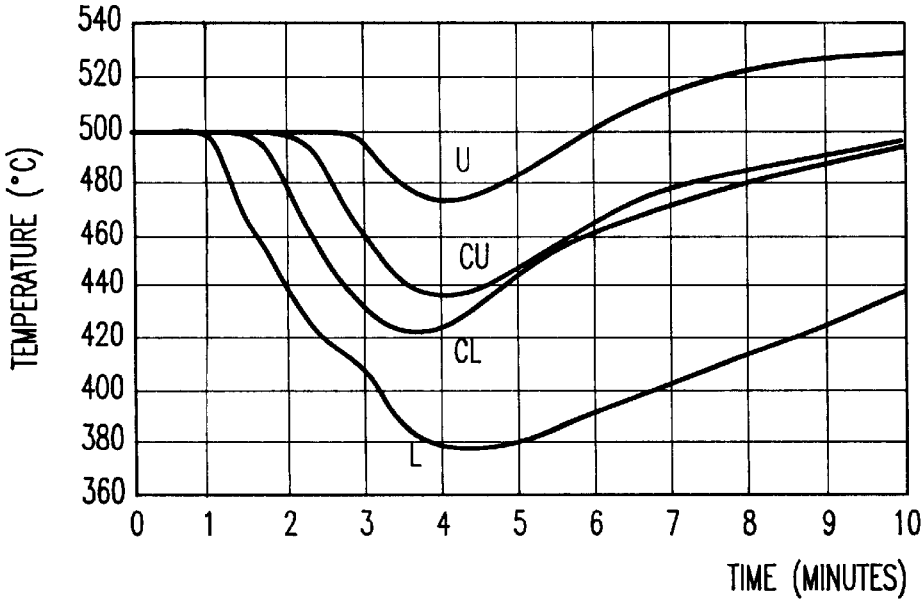
FIG. 31 is an enlarged view of FIG. 30.

Specifically, FIG. 30 (corresponding to FIGS. 29(*a*) to 29(*d*)) and FIG. 31 are views showing, for example, the cascade temperatures during the boat loading, and FIG. 30 illustrates the temperatures of the cascade thermo-couple upon loading the boat at a temperature of 500 degrees C., and FIG. 31 illustrates, on an enlarged scale, part of FIG. 30 during the time period of 0 to 10 minutes. The time at which boat loading commences is assumed to be 0 minutes.

From FIG. 31, the time durations elapsed until the furnace temperature begins to fall in the U, CU, CL and L zones are determined to be 2.4 minutes, 2.1 minutes, 1.4 minutes and 0.8 minutes, respectively.

The following simulation processing is done using the time constants and change time constants obtained. First, when the time elapsed from the beginning of boat loading is less than the times determined above, simulation is effected using the time constant before the loading of the boat.

Second, when the time elapsed from the beginning of boat loading exceeds the times determined above, simulation is effected using time constants which are calculated based on the aforementioned second order delay function while inputting the time constant before the boat loading, the time constant after the boat loading, and the time constants of change (α, β) as determined in the above manner.

In the illustrated example, the time constants of change (α, β) and the amount of change of the time constant are shown in FIGS. 28(*a*) to 28(*d*) and FIGS. 29(*a*) to 29(*d*). In the illustration of these FIGS., U_means a transfer function to be added as an output of the U zone, and for instance, U_cl shows a transfer function which outputs the interference from the CL zone to the U zone.

In the above-mentioned example, single common values are used for a time constant of change and an amount of change, in each of the U, CU, CL and L zones. This is because influences of boat loading on the respective zones are considered to be average and uniformly affect an amount which is to be added as an output of each zone, and also because the use of single common values is easy and convenient for adjustment purposes.

With this method, the result of the above example fell within an allowable tolerance (i.e., within 10 degrees C. during transition), but all the parameters may be defined, thus providing better results. Moreover, in setting the changing time constants, it is preferable that the changing time constants (α, β) are set to be values that are close to each other such as (2.9, 3.0). That is, values which are close provide more uniform rates of change, thus closely approximating the result of simulation to the actual situation. However, the term "α−β" exists in the denominator, so if α completely equals β, the approach above is not feasible. In other words, the denominator cannot be set to "0".

As to how adjustments are made, since the smaller the value, the steeper the temperature drop, adjustments are made such that if the simulated change is slower than the actual data of change, the value is decreased, and if the contrary, the value is made greater.

The initial values are each set to a range of time from the beginning of a temperature decrease to the time when the temperature begins increasing. For example, if the period from the beginning of a temperature decrease to the beginning of a temperature increase is 3 minutes, then the initial values are set to 2.9 and 3.0, respectively. The amount of change indicates the magnitude of a temperature drop or decrease, and if the simulated value of the temperature decrease is compared with the actual or measured value and is less, the amount of change is increased, and if the simulated value of the temperature decrease is greater, then the amount of change is smaller. The initial value is set to approximately 10% of the time constant (e.g., if the time constant is 50, then the initial value is set to 5). These parameters vary according to the control temperature and the speed of the boat.

Using the above procedure, it is possible to simulate, on the computer, a temperature change at the time the temperature is settled, or ramped up or during the boat loading.

Although a time change pattern has been expressed using a second order delay function, different patterns may be employed depending upon the movement of the boat.

The temperature system simulation model whose response is equivalent to the temperature change of the vertical diffusion apparatus (including four zones) shown in FIG. 32 can be modeled on a computer according to the above-mentioned procedure, so that the temperature control can be simulated on the computer.

The procedure as described is applied to a vertical diffusion apparatus with four zones, but it is also applicable to any type of electric furnace, gas furnace, steam furnace, etc.

FIGS. 12–19 show the data acquired in the open loop in each zone (in case of a quantity of manipulation plus 1%) and all the parameters of transfer functions determined therefrom. FIGS. 12, 14, 16 and 18 show the heater temperature and the parameters of heater system transfer functions, and FIGS. 13, 15, 17 and 19 show the cascade temperature and the parameters of cascade system (furnace system) transfer functions.

There is a heater (heater system) temperature and a cascade (furnace system) temperature in each zone, and the transfer function parameters (U-L zones) are indicated beneath a graph. Irregularities in data are due to variations in the power supply not always being constant and therefore cannot be eliminated.

Figure 14:
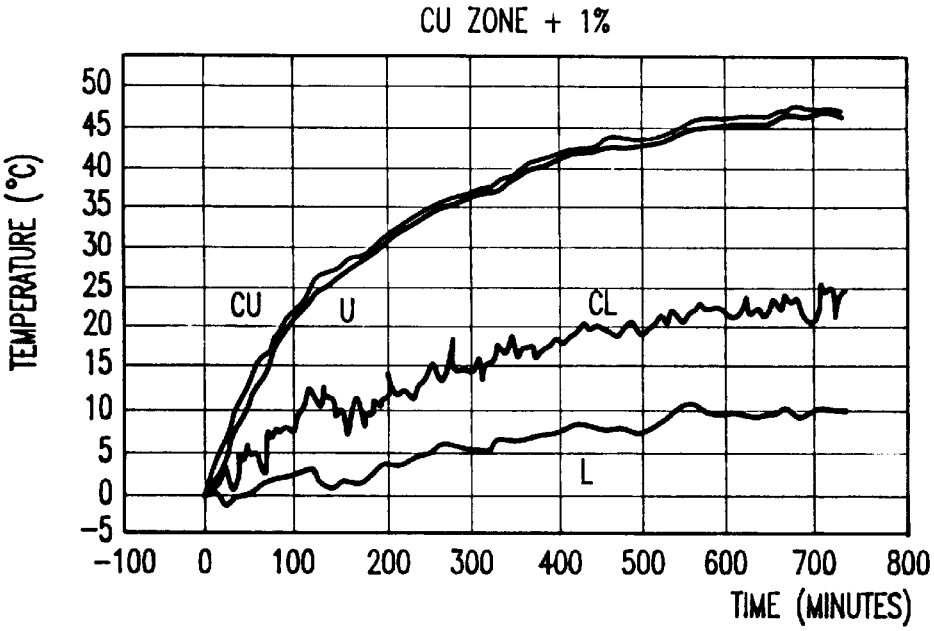
FIG. 14 is a graph showing data representative of the heater system transfer function in a CU zone.
Figure 15:
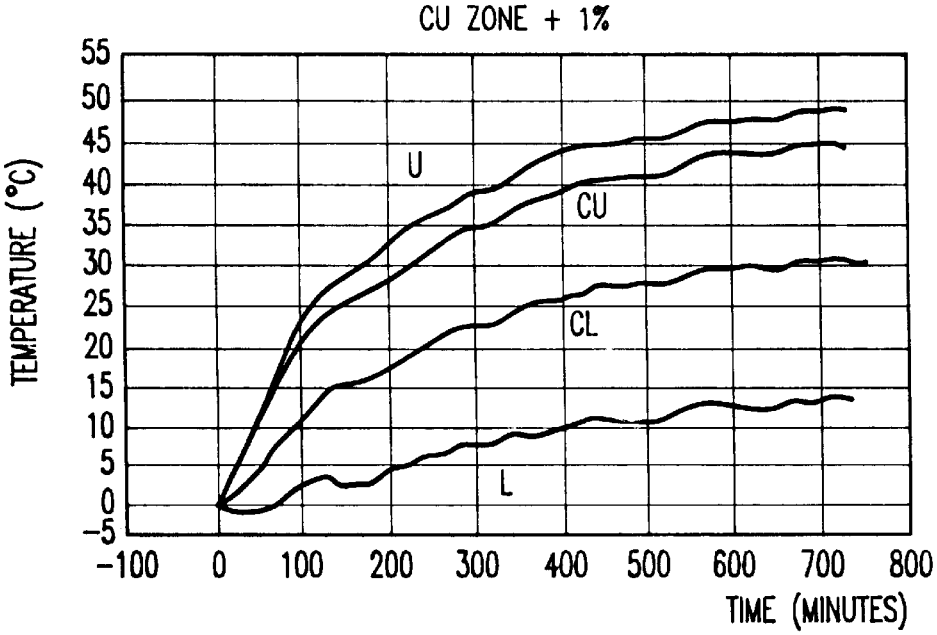
FIG. 15 is a graph showing data representative of the series transfer functions of the heater system and the furnace system in the CU zone.
Figure 16:
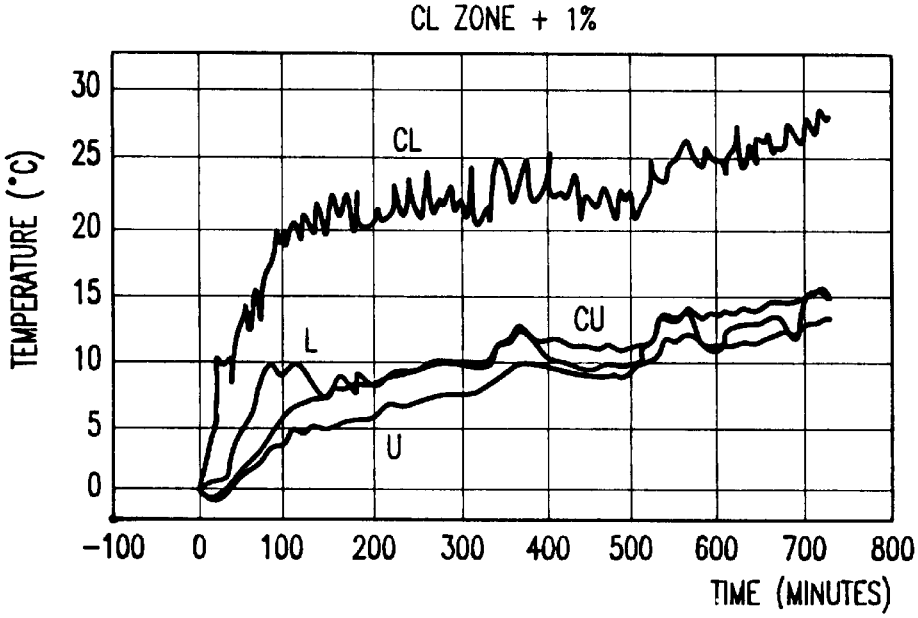
FIG. 16 is a graph showing data representative of the transfer function of the heater system in a CL zone.
Figure 17:
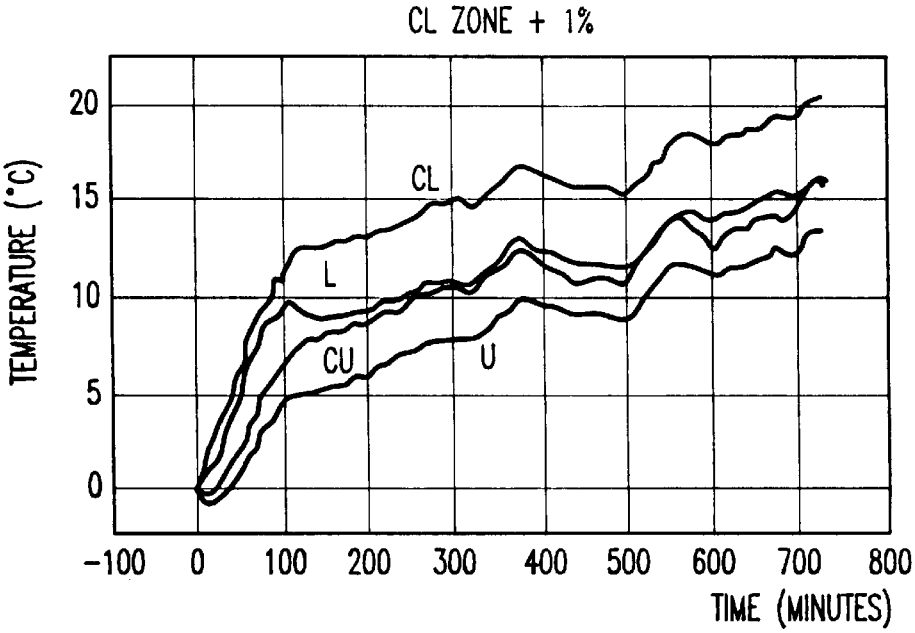
FIG. 17 is a graph showing data representative of the series transfer function of the heater system and the furnace system in the CL zone.
Figure 18:
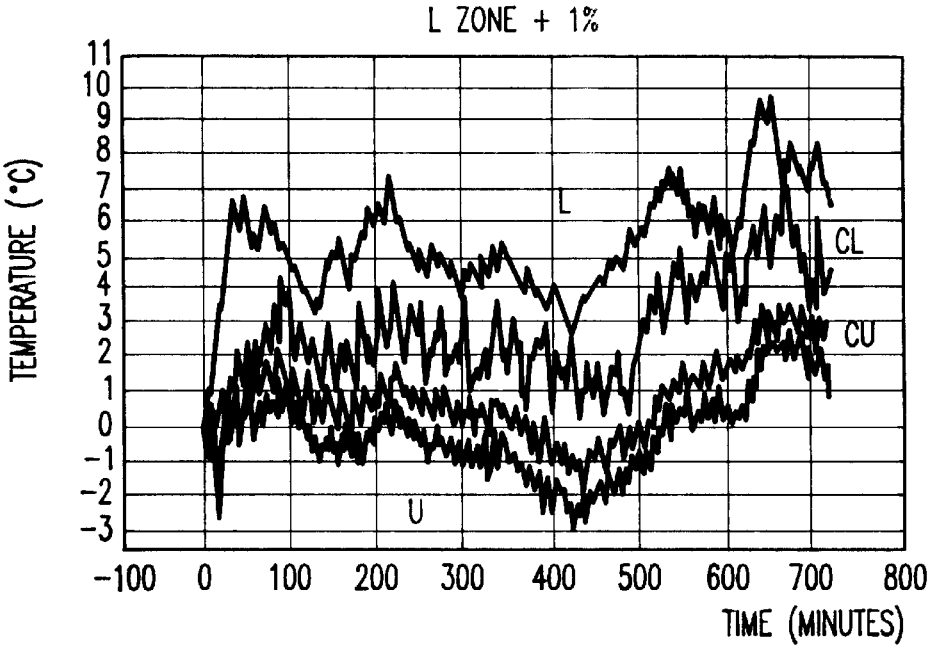
FIG. 18 is a graph showing data representative of the transfer function of the heater system in an L zone.
Figure 19:
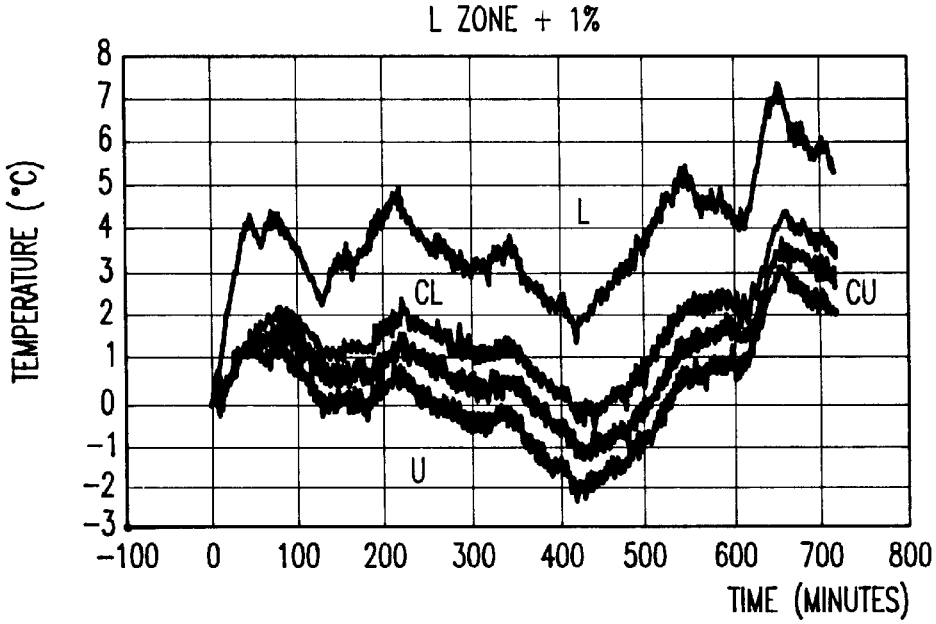
FIG. 19 is a graph showing data representative of the series transfer functions of the heater system and the furnace system in the L zone.

It is noted that symbol * in the values of respective parameters K (gain), T (time constant), L (dead time), e.g., "184*3" in FIG. 14, signifies multiplication; "184" in "1184*3" designates the data acquired in the open loop, and "3" designates a value multiplying the open loop data so as to adjust it to a closed loop parameter.

Now, a temperature control simulation system (simulation equipment) using the above-mentioned temperature system simulation device will be explained.

Figure 11:
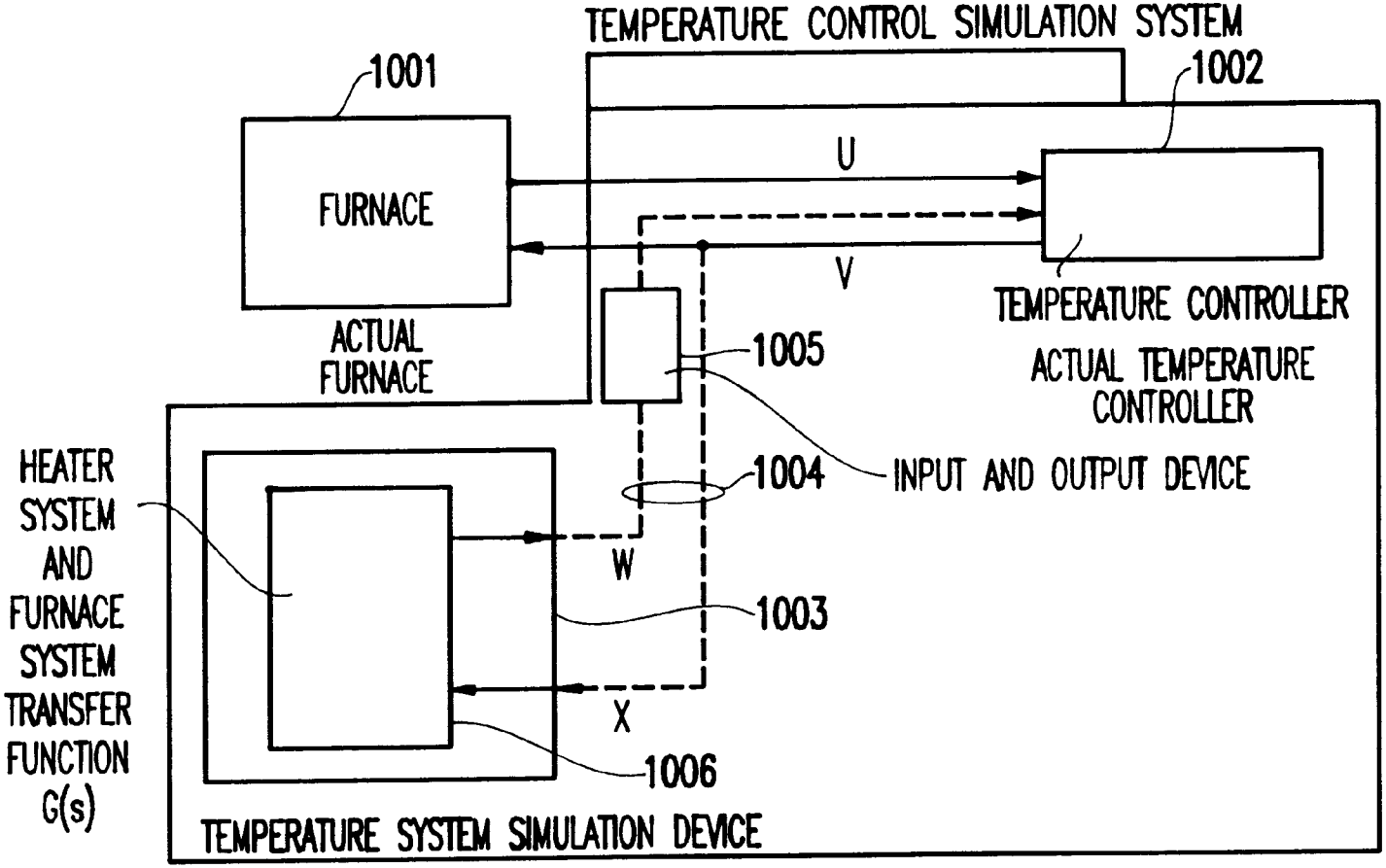
FIG. 11 shows the configuration of a temperature control simulation system.

FIG. 11 shows the configuration of the temperature control simulation system including a temperature controller 1002 for controlling the temperature of an actual furnace 1001, and a temperature system simulation device 1003 connected to the controller 1002, replacing the furnace 1001 in the form of an actual control target or object of the temperature controller 1002. This makes it possible for the controller 1002 to control the temperature system simulation device 1003 provided on a computer, as referred to above, as a virtual furnace in the form of a control target.

Specifically, the temperature system simulation device is provided with (i.e., stores therein as calculation formulae) a plurality of heater system transfer functions and a plurality of furnace system transfer functions in the respective zones, such as temperature zones (e.g., every 100 degrees C. range), over the entire temperature range in which the furnace 1001 is used.

Controller 1002 and device 1003 communicate with each other at intervals ranging from several milliseconds to several seconds.

Operation

The operation of the temperature system simulation device will now be described in detail. The temperature system simulation device 1003 and the temperature controller 1002 are connected together through a communication cable 1004, so that the simulation device 1003 converts a quantity of manipulation X received from the temperature controller 1002 into a corresponding temperature W (i.e., the result of conversion by the heater system and furnace system transfer functions 1006), which is then output to the temperature controller 1002. Similar to ordinary temperature control, the controller 1002 calculates a quantity of manipulation V based on a difference between the received temperature W and a target temperature through PID (proportional integral and differential) operations, and transmits it to the temperature system simulation device 1003.

With the heater system and furnace system transfer functions 1006, as the temperature in the furnace at the beginning of the simulation is known, a transfer function is employed in a predetermined temperature range (e.g., a temperature zone including 300 degrees C.).

However, when the temperature W calculated by the transfer function (i.e., the result of conversion of the quantity of manipulation) varies (e.g., rises) and is within a temperature range which is different from the initial temperature range, the initial transfer function is switched to one corresponding to the new temperature range. For example, such a switching of the transfer function is performed by a transfer function switcher incorporated in the temperature system simulation device. The transfer function switcher determines a specific temperature zone defined by the calculated temperature W and selectively switches over the transfer function to one corresponding to the specific temperature zone.

It should be clearly understood that the aforesaid method of setting the temperature zones and the above construction of the transfer function switcher have been described by way of example, and do not limit the present invention in any manner. Moreover, in a case where the range of the (furnace) temperature change per the simulation is limited so that the temperature characteristic of the furnace is considered constant, a single transfer function can be used for the entire temperature range, and in these cases, there is no need for a transfer function switcher.

In this example, however, since the temperature controller 1002 is constructed to receive the electromotive power detected by the thermo-couple, it is necessary to provide an input/output device 1005 at a location between the temperature system simulation device 1003 and the temperature controller 1002 to generate a voltage corresponding to the temperature W transmitted from the temperature system simulation device 1003.

With such a construction, the temperature U transmitted from the actual furnace and the temperature W sent from the temperature simulation device can be handled in the same manner.

As a consequence, the actual temperature controller 1002 need not know whether the control target is an actual furnace 1001 or a temperature system simulation device 1003.

Furthermore, because the actual temperature controller 1002 is used, the operation of the temperature control by this simulation system can be utilized as it is on an actual manufacturing site, etc.

According to the above, a temperature control simulation system can be developed and used in teaching the operation of temperature control and its manipulation using the actual temperature controller without requiring an actual furnace.

It will be clearly understood that the temperature range referred to above is just one example, and the present invention can be applied to any arbitrary temperature range corresponding to a temperature range actually used for temperature control.

In the embodiments described above, parameters of transfer functions such as gains, time constants, etc., are determined by the stepped response. However, other processes or methods can be used, such as in a method employing a system identification theory in which a transfer function model having certain parameters is used, the parameters being adjusted on a computer so as to make input and output data of this model match the measured data.

As explained in detail in the foregoing, according to the present invention, part of educating and training such as on the methodology of temperature control manipulation and the development of temperature control systems, which have conventionally been done only by using an actual apparatus or system, can be replaced by computer simulation. For this reason, there will be no danger from high temperatures, noxious gas, etc., and costs for expensive apparatuses, the area or space for installation, can be reduced considerably. Furthermore, it is possible to simulate a temperature change during process treatment while shortening the process execution time, i.e., 3–6 hours (required of conventional apparatuses using an actual device(s)) to about 5 minutes–1 hour.

While the invention has been described in terms of several preferred embodiments, those skilled in the art will recognize that the invention can be practiced with modification within the spirit and scope of the appended claims.

What is claimed is:

1. A temperature control simulation method for simulating temperature control on a heating furnace equipped with a heater by using a temperature system simulation device, said method comprising:

determining transfer function means representative of a relationship between an input to said heater and a temperature of said heating furnace;

simulating temperature control on said heating furnace by using said transfer function means as a transfer function means of said temperature system simulation device; and obtaining a temperature output as a temperature control result based on said input to said heater without using an actual furnace;

wherein said transfer function means comprises a parameter which changes over time in accordance with a temperature control process, and wherein said temperature control process comprises a process of controlling a temperature of said heating furnace during a time when a boat is loaded into said heating furnace, and said parameter of said transfer function means which changes over time comprises a time constant.

2. The temperature control simulation method of claim 1, wherein said parameter which changes over time comprises a second order delay curve.

3. A temperature control simulation method for simulating temperature control on a heating furnace equipped with a heater by using a temperature system simulation device, said method comprising:

determining transfer function means representative of a relationship between an input to said heater and a temperature of said heating furnace;

simulating temperature control on said heating furnace by using said transfer function means as a transfer function means of said temperature system simulation device; and obtaining a temperature output as a temperature control result based on said input to said heater without using an actual furnace, wherein said heating furnace comprises a plurality of heating zones, and said heater comprises a plurality of heaters provided one for each of said plurality of heating zones, and said transfer function means comprises interference between said heating zones.

4. The temperature control simulation method according to claim 3, wherein said transfer function means is determined by:

measuring an output of said heating furnace when a stepped input is applied to one of said plurality of heaters;

repeating an operation of measuring an output of said heating furnace for all remaining heaters of said plurality of heaters; and calculating said transfer function means based on said measured outputs of said heating furnace.

5. The temperature control simulation method according to claim 4, wherein said transfer function means is calculated from a stepped response of each of said plurality of heaters comprising:

measuring a temperature output of said heating furnace when a stepped input is applied to each of said plurality of heaters;

measuring a temperature output of each of said heaters when a constant input is applied to each of said heaters at the same point of time as when said stepped input is applied to calculate a change over time of said temperature output of each of said heaters; and calculating said transfer function means based on said temperature output response value which is subtracted by said change over time of said temperature output of each of said heaters to cancel variations in a power supply which supplies electric power to said heaters.

6. The temperature control simulation method according to claim 1, wherein said transfer function means comprises a plurality of transfer functions corresponding to a plurality of different temperature zones, and wherein said plurality of transfer functions are switched to select an appropriate one corresponding to each of said plurality of temperature zones.

* * * * *